US007506622B2

(12) United States Patent
Takahashi et al.

(10) Patent No.: US 7,506,622 B2
(45) Date of Patent: Mar. 24, 2009

(54) VALVE TIMING CONTROL SYSTEM

(75) Inventors: Kinya Takahashi, Obu (JP); Masayasu Ushida, Okazaki (JP); Takao Nojiri, Anjo (JP); Seiji Yaokou, Anjo (JP); Jun Yamada, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 21 days.

(21) Appl. No.: 11/854,249

(22) Filed: Sep. 12, 2007

(65) Prior Publication Data

US 2008/0060471 A1 Mar. 13, 2008

(30) Foreign Application Priority Data

Sep. 12, 2006 (JP) ..... 2006-246715

(51) Int. Cl.
*F01L 1/34* (2006.01)

(52) U.S. Cl. ..... 123/90.15; 123/90.12; 123/90.17; 464/160

(58) Field of Classification Search ..... 123/90.12, 123/90.13, 90.15, 90.16, 90.17, 90.18, 90.27, 123/90.31; 464/1, 2, 160
See application file for complete search history.

(56) References Cited

U.S. PATENT DOCUMENTS 7,182,052 B2 2/2007 Yaoko et al.
7,194,992 B2 * 3/2007 Smith ..... 123/90.17
2007/0107684 A1 5/2007 Takahashi et al.

FOREIGN PATENT DOCUMENTS

JP 2006-46315 2/2006

OTHER PUBLICATIONS

U.S. Appl. No. 11/783,002, filed Apr. 2007, Ushida et al.
U.S. Appl. No. 11/854,337, filed Sep. 12, 2007, Takahashi et al.
U.S. Appl. No. 11/854,156, filed Sep. 12, 2007, Takahashi et al.

* cited by examiner

*Primary Examiner*—Ching Chang
(74) *Attorney, Agent, or Firm*—Nixon & Vanderhye PC

(57) ABSTRACT

One of retard passages, which supplies working fluid to one of retard chambers, is a dedicated passage. The other remaining retard passages, which supply the working fluid to the other remaining retard chambers, are branch passages, which are branched from a retard passage that serves as a supply passage. With this construction, a flow quantity of working fluid per unit time supplied from the one of retard passages to the one of retard chambers becomes larger than a flow quantity of working fluid per unit time supplied from the other remaining retard passages to the other remaining retard chambers. Thus, the one of retard chambers can be filled with the working fluid earlier than the other remaining retard chambers.

22 Claims, 13 Drawing Sheets

POSITIVE / NEGATIVE TORQUE IN RETARD TIME
CHECK VALVE : CLOSED
CONTROL VALVE : OPEN

POSITIVE TORQUE IN ADVANCE TIME
CHECK VALVE : CLOSED
CONTROL VALVE : CLOSED

NEGATIVE TORQUE IN ADVANCE TIME
CHECK VALVE : OPEN
CONTROL VALVE : CLOSED

POSITIVE / NEGATIVE TORQUE IN SUSTAINING TIME
CHECK VALVE : CLOSED
CONTROL VALVE : CLOSED

POSITIVE TORQUE IN RETARD TIME
CHECK VALVE : OPEN
CONTROL VALVE : CLOSED

NEGATIVE TORQUE IN RETARD TIME
CHECK VALVE : CLOSED
CONTROL VALVE : CLOSED

POSITIVE / NEGATIVE TORQUE IN ADVANCE TIME
CHECK VALVE : CLOSED
CONTROL VALVE : OPEN

POSITIVE / NEGATIVE TORQUE IN SUSTAINING TIME
CHECK VALVE : CLOSED
CONTROL VALVE : CLOSED

VALVE TIMING CONTROL SYSTEM

CROSS REFERENCE TO RELATED APPLICATION

This application is based on and incorporates herein by reference Japanese Patent Application No. 2006-246715 filed on Sep. 12, 2006.

BACKGROUND OF THE INVENTION

1. Field of the Invention

The present invention relates to a valve timing control system, which adjusts opening and closing timing (hereinafter, referred to as the valve timing) of at least one of an intake valve and an exhaust valve of an internal combustion engine.

2. Description of Related Art

For example, as recited in Japanese Unexamined Patent Publication No. 2006-46315 (corresponding to U.S. Pat. No. 7,182,052), a previously proposed valve timing control system includes a housing and a vane rotor. The housing receives a drive force of a crankshaft of the internal combustion engine, and the vane rotor is received in the housing and transmits the drive force of the crankshaft to the camshaft. The valve timing control system employs the pressure of a working fluid in a retard chamber and an advance chamber to drive the vane rotor to rotate toward the retard side or the advance side relative to the housing. In this way, the phase of the camshaft relative to the crankshaft is adjusted, i.e., the valve timing is adjusted.

When the intake valve or the exhaust valve is opened or closed in such a valve timing control system, the torque fluctuation, which is received by the camshaft from the intake valve or exhaust valve, is conducted to the vane rotor. Thus, the vane rotor receives the torque fluctuation toward the retard side and the advance side relative to the housing.

For example, in the case where the working fluid is supplied to the advance chamber to change the phase of the camshaft relative to the crankshaft from the retard side to a target phase on the advance side, when the vane rotor receives the torque fluctuation toward the retard side, the vane rotor receives the torque fluctuation in the direction for causing a reduction in the volume of the advance chamber. Thus, the working fluid in the advance chamber receives the force that causes discharge of the hydraulic fluid from the advance chamber. When the vane rotor receives the torque fluctuation toward the retard side during the advance control operation, the pressure of the working fluid in the advance chamber cannot overcome the torque fluctuation. This causes the vane rotor to be pushed back toward the retard side due to the torque fluctuation as shown by the dotted line of FIG. 13. This may result in a longer response time before achievement of the target phase. This disadvantageous phenomenon becomes particularly prominent when the pressure of the working fluid, which is supplied from a fluid source, is relatively low.

In view of this, as recited in Japanese Unexamined Patent Publication No. 2006-46315, it is conceivable to provide a check valve in a supply passage, which supplies the working fluid to the advance chamber, to limit the discharge of the working fluid from the advance chamber even when the vane rotor receives the torque fluctuation in the retard control operation. In this way, as indicated by a solid line in FIG. 13, it is possible to limit the returning of the vane rotor to the side opposite from the target phase relative to the housing in the phase control operation, and thereby the response in the phase control operation can be improved.

In the case where the check valve is provided in the supply passage, which supplies the working fluid to the retard chamber, when the advance chamber is filled with the working fluid, the discharge of the working fluid from the retard chamber can be limited even when the vane rotor receives the torque fluctuation toward the retard side in the relatively low pressure state of the working fluid.

However, in the case where the pressure of the working fluid supplied from the fluid source is relatively low, and the quantity of the working fluid supplied from the fluid source is relatively small, the time required to fill the advance chamber with the working fluid is lengthened at the time of, for example, supplying the working fluid to the retard chamber to execute the phase control operation toward the advance side. When the vane rotor receives the torque fluctuation toward the retard side before completion of the filling of the advance chamber with the working fluid, the vane rotor is returned toward the retard side, so that the response up to reaching of the target phase is disadvantageously reduced.

SUMMARY OF THE INVENTION

The present invention addresses the above disadvantage. Thus, it is an objective of the present invention to provided a valve timing control system that enables a higher flow rate of working fluid, which is supplied to at last one of a retard chamber and an advance chamber connected with a corresponding passage having a phase check valve, in comparison to that of a corresponding one of another retard chamber and another advance chamber that is connected to another passage.

To achieve the objective of the present invention, there is provided a valve timing control system installed in a drive transmission system that transmits a drive force from a drive shaft of an internal combustion engine to a follower shaft, which opens and closes at least one of an intake valve and an exhaust valve of the internal combustion engine, so that the valve timing control system adjusts opening and closing timing of the at least one of the intake valve and the exhaust valve. The valve timing control system includes a housing, a vane rotor, a passage arrangement, at least one phase check valve and at least one drain control valve. The housing is rotated together with one of the drive shaft and the follower shaft and has at least three receiving chambers, each of which is formed within a predetermined angular range in a rotational direction. The vane rotor is rotated together with the other one of the drive shaft and the follower shaft and has at least three vanes, each of which is received in a corresponding one of the at least three receiving chambers to partition the receiving chamber into a corresponding retard chamber and a corresponding advance chamber. The vane rotor is driven to rotate in a corresponding one of a retard side and an advance side relative to the housing by a pressure of working fluid in a corresponding one of each retard chamber and each advance chamber of the at least three receiving chambers, so that a relative phase of the vane rotor relative to the housing is controlled. The passage arrangement includes a group of at least three retard passages, each of which connects between a fluid source side and a corresponding one of the retard chambers of the at least three receiving chambers, and a group of at least three advance passages, each of which connects between the fluid source side and a corresponding one of the advance chambers of the at least three receiving chambers. The at least one phase check valve is installed in at least one predetermined passage, respectively, which is selected from the group of at least three retard passages and the group of at least three advance passages. Each phase check valve limits the working fluid to flow from a corresponding check valve connecting chamber, which is a corresponding one of the retard chambers and the advance chambers of the at least three receiving chambers connected to the phase check valve, toward the fluid source, while the phase check valve permits the working fluid to flow form the fluid source to the corresponding check valve connecting chamber. Each of the at least one drain control valve is driven by a pilot pressure exerted by the working fluid from the fluid source and is installed in a corresponding one of at least one fluid discharge passage, which is provided separately from the group of at least three retard passages and the group of at least three advance passages to discharge the working fluid from the check valve connecting chamber that is associated with a corresponding one of the at least one phase check valve. Each drain control valve blocks the corresponding fluid discharge passage when the working fluid is supplied from the fluid source to the check valve connecting chamber associated with the corresponding one of the at least one phase check valve to rotate the vane rotor in a corresponding one of the retard side and the advance side relative to the housing. The drain control valve opens the corresponding fluid discharge passage when the working fluid is discharged from the check valve connecting chamber associated with the corresponding one of the at least one phase check valve to rotate the vane rotor in the other one of the retard side and the advance side relative to the housing. Each of the at least one predetermined passage is a dedicated passage connected to the corresponding one of the retard chambers and the advance chambers of the at least three receiving chambers while remaining two or more of the at least three retard passages or the at least three advance passages of the same group, from which the predetermined passage is selected, are branched from a corresponding common passage that is connected to the fluid source side.

To achieve the objective of the present invention, there is also provided a valve timing control system installed in a drive transmission system that transmits a drive force from a drive shaft of an internal combustion engine to a follower shaft, which opens and closes at least one of an intake valve and an exhaust valve of the internal combustion engine, so that the valve timing control system adjusts opening and closing timing of the at least one of the intake valve and the exhaust valve. The valve timing control system includes a housing, a vane rotor, a passage arrangement, at least one phase check valve and at least one drain control valve. The housing is rotated together with one of the drive shaft and the follower shaft and has a plurality of receiving chambers, each of which is formed within a predetermined angular range in a rotational direction. The vane rotor is rotated together with the other one of the drive shaft and the follower shaft and has a plurality of vanes, each of which is received in a corresponding one of the plurality of receiving chambers to partition the receiving chamber into a corresponding retard chamber and a corresponding advance chamber. The vane rotor is driven to rotate in a corresponding one of a retard side and an advance side relative to the housing by a pressure of working fluid in a corresponding one of each retard chamber and each advance chamber of the plurality of receiving chambers, so that a relative phase of the vane rotor relative to the housing is controlled. The passage arrangement includes a group of retard passages, each of which connects between a fluid source side and a corresponding one of the retard chambers of the plurality of receiving chambers, and a group of advance passages, each of which connects between the fluid source side and a corresponding one of the advance chambers of the plurality of receiving chambers. The at least one phase check valve is installed in at least one predetermined passage, respectively, which is selected from the group of retard passages and the group of advance passages. Each phase check valve limits the working fluid to flow from a corresponding check valve connecting chamber, which is a corresponding one of the retard chambers and the advance chambers of the plurality of receiving chambers connected to the phase check valve, toward the fluid source, while the phase check valve permits the working fluid to flow form the fluid source to the corresponding check valve connecting chamber. Each of the at least one drain control valve is driven by a pilot pressure exerted by the working fluid from the fluid source and is installed in a corresponding one of at least one fluid discharge passage, which is provided separately from the group of retard passages and the group of advance passages to discharge the working fluid from the check valve connecting chamber that is associated with a corresponding one of the at least one phase check valve. Each drain control valve blocks the corresponding fluid discharge passage when the working fluid is supplied from the fluid source to the check valve connecting chamber associated with the corresponding one of the at least one phase check valve to rotate the vane rotor in a corresponding one of the retard side and the advance side relative to the housing. The drain control valve opens the corresponding fluid discharge passage when the working fluid is discharged from the check valve connecting chamber associated with the corresponding one of the at least one phase check valve to rotate the vane rotor in the other one of the retard side and the advance side relative to the housing. A pressure loss of each of the at least one predetermined passage is set to be smaller than that of remaining one or more of the retard passages or the advance passages of the same group, from which the predetermined passage is selected.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the present invention will be described with reference to the accompanying drawings.

First Embodiment

A valve timing control system according to a first embodiment of the present invention is shown in FIGS. 1 to 7D. The valve timing control system 1 of the present embodiment is of a hydraulic control type, which employs hydraulic fluid as its working fluid and controls the valve timing of an intake valve(s) of an internal combustion engine.

Figure 2:
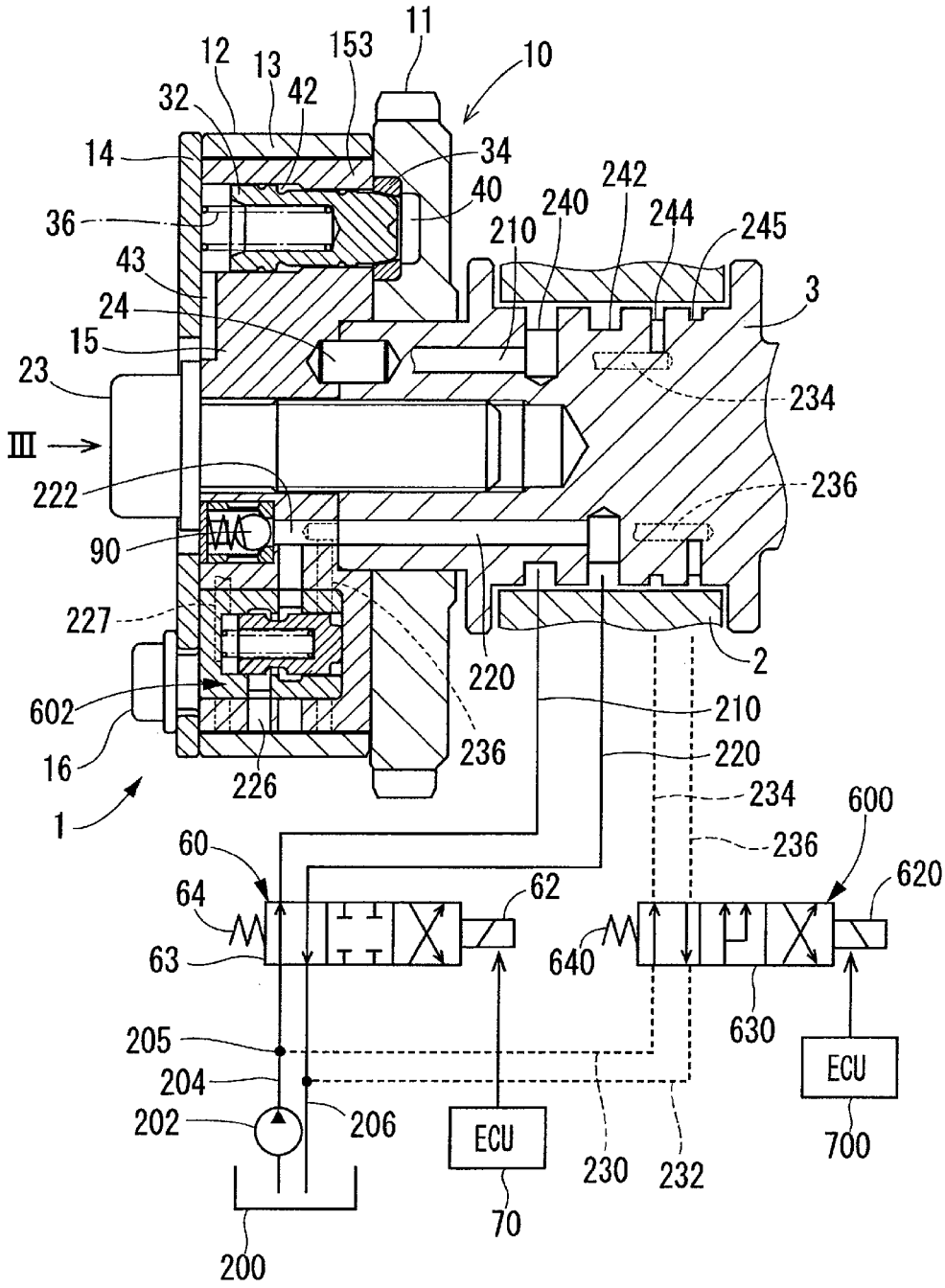
FIG. 2 is a longitudinal sectional view illustrating the valve timing control system according to the first embodiment.

As shown in FIG. 2, a housing 10, which serves as a drive-side rotatable body, includes a chain sprocket 11, a shoe housing 12, and a front plate 14. The shoe housing 12 has shoes 121-123, which serve as partitioning members (see FIG. 3), and an annular peripheral wall 13. The front plate 14 is placed on a side of the peripheral wall 13, which is opposite from the chain sprocket 11, so that the peripheral wall 13 is held between the front plate 14 and the chain sprocket 11. Furthermore, the front plate 14 is fixed in place with bolts 16 in such a manner that the front plate 14 is coaxial with the chain sprocket 11 and the shoe housing 12. The chain sprocket 11 is connected to a crankshaft, which serves as a drive shaft of an internal combustion engine (not shown), through a chain (not shown) and receives a drive force therefrom to rotate synchronously with the crankshaft.

The drive force of the crankshaft is transferred via the valve timing control system 1 to a camshaft 3, which serves as a follower shaft and drives an intake valve (not shown) to open and close the same. The camshaft 3 is fitted into the chain sprocket 11, and is rotatable with a predetermined phase difference relative to the chain sprocket 11.

A vane rotor 15, which serves as a follower-side rotatable body, abuts against the end face of the camshaft 3 along its rotational axis. The camshaft 3 and the vane rotor 15 are fixed coaxially with a bolt 23. The vane rotor 15 and the camshaft 3 are set in position in their rotational direction by fitting a positioning pin 24 into the vane rotor 15 and the camshaft 3. The camshaft 3, the housing 10, and the vane rotor 15 rotate in a clockwise direction when viewed in a direction of an arrow III in FIG. 2. Hereinafter, this rotational direction is defined as the advance direction (also referred as the advance side) of the camshaft 3 relative to the crankshaft.

Figure 3:
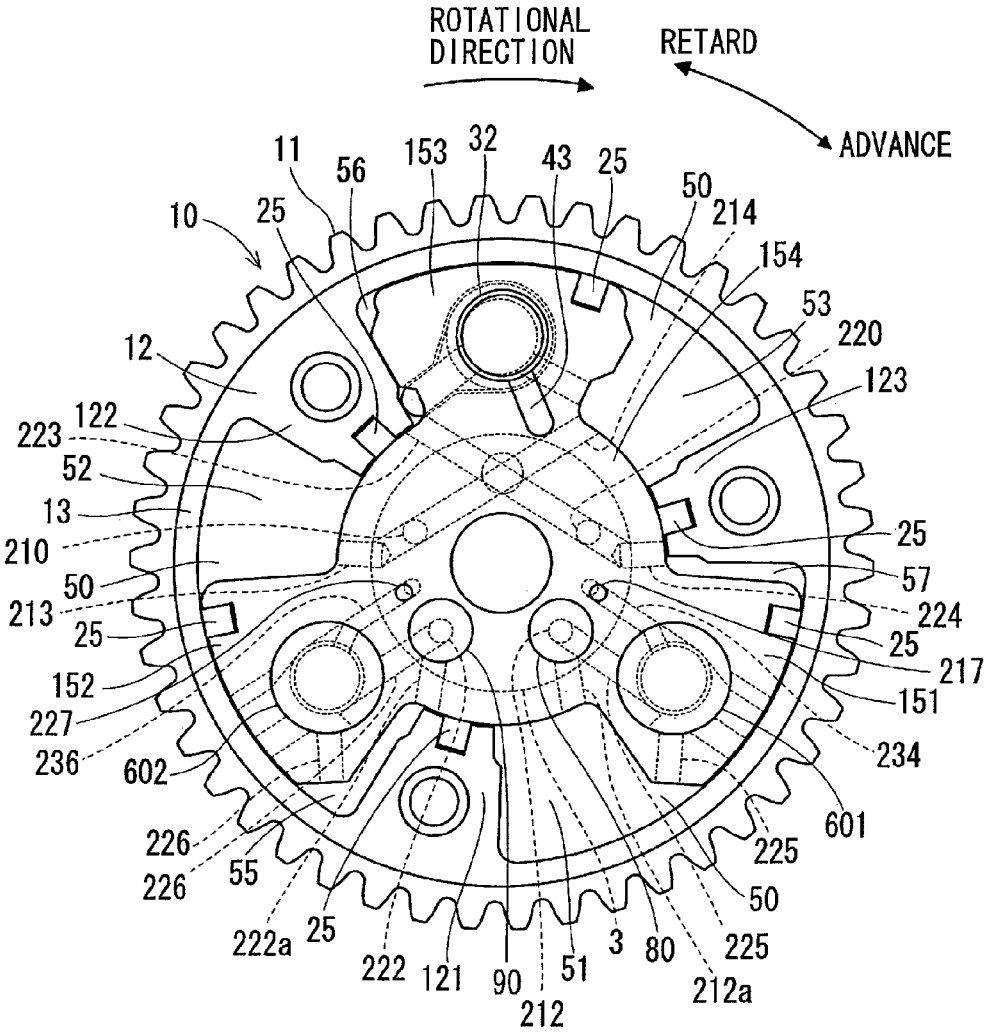
FIG. 3 is a view taken in a direction of an arrow III in FIG. 2 in a state where a front plate is removed from the valve timing control system.

As shown in FIG. 3, the shoes 121-123, which are trapezoidal in shape, extend radially inwardly from the peripheral wall 13 and are disposed at generally regular intervals in the rotational direction of the peripheral wall 13. The shoes 121-123 define three sector-shaped spaces therebetween, each space being formed within a predetermined angular range in the rotational direction. Each of these three spaces serves as a receiving chamber 50 for accommodating each of vanes 151-153.

The vane rotor 15 has a boss portion 154 coupled to the camshaft 3 at the axial end face, and the vanes 151-153 disposed at generally regular intervals in the rotational direction on the outer circumference of the boss portion 154. The vane rotor 15 is accommodated in the housing 10 in such a manner that the vane rotor 15 is rotatable relative to the housing 10. The vanes 151-153 are accommodated rotatably in the chambers 50, respectively. Each vane 151-153 divides the corresponding chamber 50 into two portions, i.e., a retard chamber and an advance chamber. The arrows of FIG. 1, which respectively indicate a retard direction (retarded) and an advance direction (advanced), represent the retard direction and the advance direction, respectively, of the vane rotor 15 relative to the housing 10.

A sealing member 25 is disposed in a corresponding slide gap, which is formed between the corresponding shoe 121-123 and the boss portion 154, which radially oppose each other. Also, a sealing member 25 is disposed in a corresponding slide gap, which is formed between the corresponding vane 151-153 and an inner peripheral wall surface of the peripheral wall 13. The sealing members 25 are fitted into a groove provided in an inner peripheral wall of each shoe 121-123 and a groove provided in an outer peripheral wall of each vane 151-153. Furthermore, the sealing members 25 are urged by a spring or the like against the outer peripheral wall surface of the boss portion 154 and the inner peripheral wall surface of the peripheral wall 13. With the above structure, each sealing member 25 limits a leakage flow of the hydraulic fluid between the corresponding retard chamber and the corresponding advance chamber, which are adjacent to each other.

As shown in FIG. 2, a cylindrical stopper piston 32 is accommodated in a through hole of the vane 153 in such a manner that the stopper piston 32 is slidable in the direction of the rotational axis. A fit ring 34 is press fitted and retained in a recess formed in the chain sprocket 11. The stopper piston 32 can be fitted into the fit ring 34. The fit sides of the stopper piston 32 and of the fit ring 34, which are fitted together, are tapered, so that the stopper piston 32 can be smoothly fitted into the fit ring 34. A spring 36, which serves as a resilient member, applies a load to the stopper piston 32 toward the fit ring 34. The stopper piston 32, the fit ring 34, and the spring 36 constitute a restriction means for restricting the rotation of the vane rotor 15 relative to the housing 10.

A hydraulic chamber 40 is provided on the chain sprocket 11 side of the stopper piston 32, and a hydraulic chamber 42 is provided on the outer circumference of the stopper piston 32. The pressure of hydraulic fluid supplied to the hydraulic chamber 40 and pressure of hydraulic fluid supplied to the hydraulic chamber 42 act in a direction for disconnecting the stopper piston 32 away from the fit ring 34. The hydraulic chamber 40 communicates with one of the advance chambers, discussed later, and the hydraulic chamber 42 communicates with one of the retard chambers. A distal end portion of the stopper piston 32 can be fitted into the fit ring 34 when the vane rotor 15 is located at the most retarded position relative to the housing 10. In the fitted state where the stopper piston 32 is fitted in the fit ring 34, the rotation of the vane rotor 15 relative to the housing 10 is restricted. A back pressure release groove 43 is provided in a portion of the vane rotor 15, which is located on a side of the stopper piston 32 that is opposite from the fit ring 34. The back pressure release groove 43 releases a back pressure, which changes when the stopper piston 32 slides.

When the vane rotor 15 rotates relative to the housing 10 from the most retarded position toward the advance side, the stopper piston 32 is displaced from the fit ring 34 in the rotational direction. Thus, the stopper piston 32 cannot be fitted into the fit ring 34.

As shown in FIG. 3, the retard chamber 51 is formed between the shoe 121 and the vane 151. Furthermore, the retard chamber 52 is formed between the shoe 122 and the vane 152. Also, the retard chamber 53 is formed between the shoe 123 and the vane 153. Additionally, the advance chamber 55 is formed between the shoe 121 and the vane 152. Also, the advance chamber 56 is formed between the shoe 122 and the vane 153. Furthermore, the advance chamber 57 is formed between the shoe 123 and the vane 151.

Figure 1:
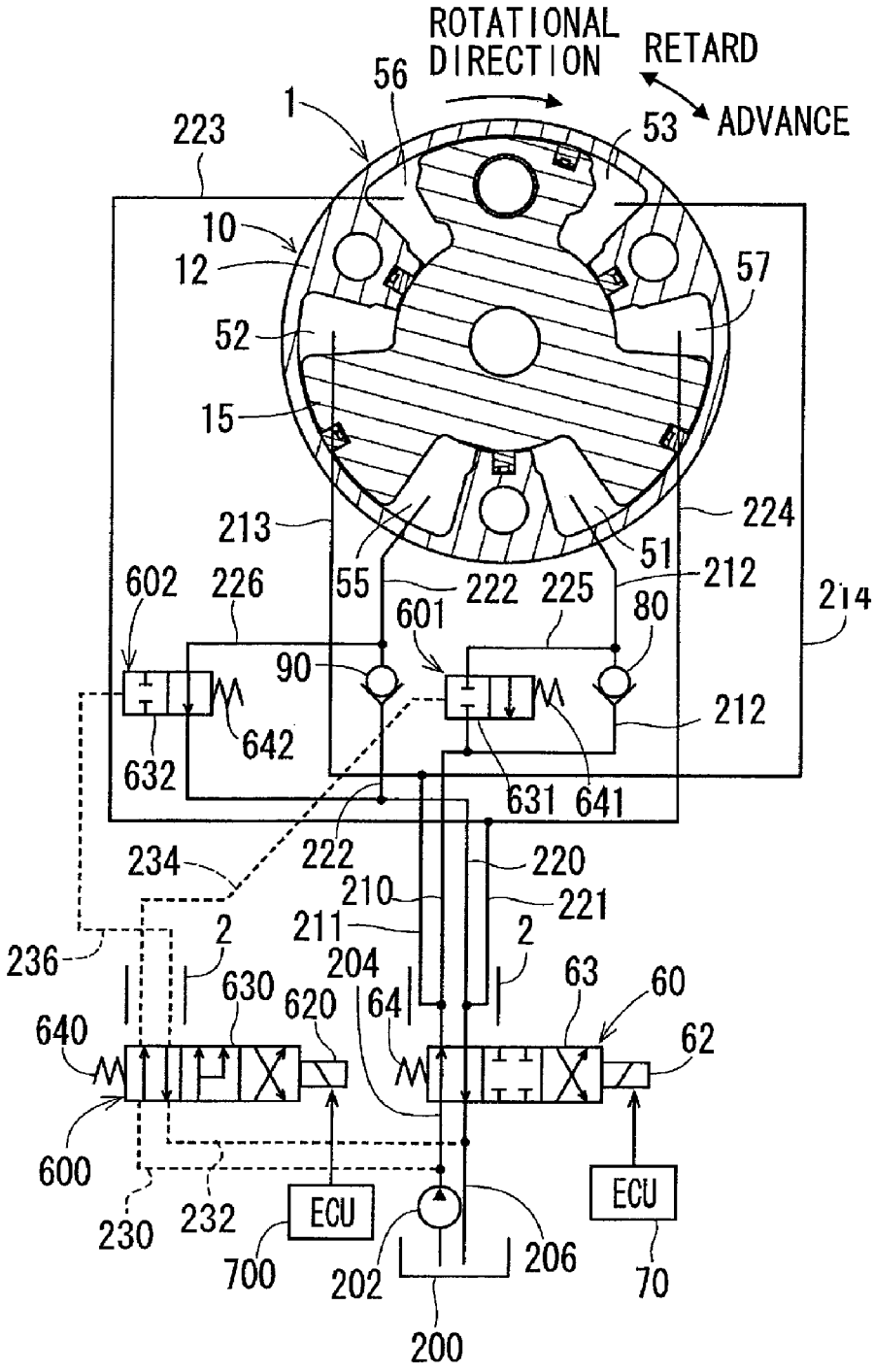
FIG. 1 is a schematic diagram illustrating a valve timing control system in a retard control operation according to a first embodiment of the present invention.

A hydraulic pump 202 of FIG. 1, which serves as a fluid source, pumps the hydraulic fluid from an oil pan 200 to a supply passage 204. A phase switch valve 60 is a solenoid spool valve of a known type and is located on a hydraulic pump 202 side of the bearing 2. The phase switch valve 60 is switched by a duty ratio controlled drive current, which is supplied from an electronic control unit (ECU) 70 to a solenoid drive arrangement 62. A spool 63 of the phase switch valve 60 is displaced according to the duty ratio of the drive current. Depending on the position of the spool 63, the phase switch valve 60 is switched to supply the hydraulic fluid to each retard chamber or each advance chamber or to discharge the hydraulic fluid from each retard chamber or each advance chamber. The hydraulic fluid in each retard chamber or each advance chamber is discharged via the phase switch valve 60 to the oil pan 200 through a discharge passage 206. In the off state where the power supply to the phase switch valve 60 is turned off, the spool 63 is placed in the position shown in FIG. 1 due to the load applied from a spring 64.

Additionally, the hydraulic pump 202 pumps and thereby supplies the hydraulic fluid from the oil pan 200 into the supply passage 230. A drain switch valve 600 is switched by a duty ratio controlled drive current, which is supplied from an electronic control unit (ECU) 700 to a solenoid drive arrangement 620. A spool 630 of the drain switch valve 600 is displaced according to the duty ratio of the drive current. Depending on the position of the spool 630, the drain switch valve 600 is switched to supply the hydraulic fluid to a first-side control valve 601 or a second-side control valve 602 or to discharge the hydraulic fluid from the first-side control valve 601 or the second-side control valve 602. In the off state where the power supply to the drain switch valve 600 is turned off, the load applied by a spring 640 causes the spool 630 to sit at the position shown in FIG. 1. The hydraulic fluid, which is discharged from the first-side control valve 601 and the second-side control valve 602, is drained from the drain switch valve 600 into the oil pan 200 through a discharge passage 232. The first-side control valve 601 and the second-side control valve 602 correspond to drain control valves of the present invention.

As shown in FIG. 2, annular passages 240, 242, 244, 245 are formed in the outer peripheral wall of the camshaft 3, which is rotatably supported by the bearing 2. A retard passage 210 extends from the phase switch valve 60 and passes through the annular passage 240 into the camshaft 3 and the boss portion 154 of the vane rotor 15. Furthermore, an advance passage 220 extends from the phase switch valve 60 and passes through the annular passage 242 into the camshaft 3 and the boss portion 154 of the vane rotor 15.

As shown in FIG. 1, the retard passage 210 is connected to the retard chamber 51 through a retard passage 212 and a first-side check valve 80. The retard passage 211 is branched from the retard passage 210, and retard passages 213, 214 are branched from the retard passage 211. The retard passages 213, 214 are connected to the retard chambers 52, 53, respectively. As described above, the retard passage 212 is connected to the retard passage 210, and the retard passages 213, 214 are branched from the retard passage 211, which serves as a common passage.

The retard passages 210, 211, 212, 213, 214 supply the hydraulic fluid from the supply passage 204 through the phase switch valve 60 to each retard chamber 51, 52, 53. Furthermore, the retard passages 210, 211, 212, 213, 214 discharge the hydraulic fluid from each retard chamber 51, 52, 53 through the phase switch valve 60 along the discharge passage 206 to the oil pan 200, which is a fluid discharge side. Accordingly, each of the retard passages 210, 211, 212, 213, 214 serves as both a retard supply passage and a retard discharge passage.

The advance passage 220 is connected to the advance chamber 55 through the advance passage 222 and a second-side check valve 90. An advance passage 221 is branched from the advance passage 220, and advance passages 223, 224 are branched from the advance passage 221. The advance passages 223, 224 are connected to the advance chambers 56, 57, respectively. As described above, the advance passage 222 is connected to the advance passage 220, and the advance passages 223, 224 are branched from the advance passage 221, which serves as a common passage.

The advance passages 220, 221, 222, 223, 224 supply the hydraulic fluid from the supply passage 204 through the phase switch valve 60 to each advance chamber 55, 56, 57. Furthermore, the advance passages 220, 221, 222, 223, 224 discharge the hydraulic fluid from each advance chamber 55, 56, 57 through the phase switch valve 60 along the discharge passage 206 to the oil pan 200, which is the fluid discharge side. Accordingly, each of the advance passages 220, 221, 222, 223, 224 serves as both an advance supply passage and an advance discharge passage.

With the passage arrangement configured in the above described manner, the hydraulic fluid can be supplied from the hydraulic pump 202 to the retard chambers 51, 52, 53, the advance chambers 55, 56, 57, and the hydraulic chambers 40, 42. Furthermore, the hydraulic fluid can be discharged from each hydraulic chamber to the oil pan 200. The camshaft 3 and the vane rotor 15, which form the retard passages 210, 211, 212, 213, 214 and the advance passages 220, 221, 222, 223, 224, serve as a fluid passage portion of the present invention.

The first-side check valve 80 is provided in the retard passage 212 among the retard passages 212, 213, 214, which are connected respectively to the retard chambers 51, 52, 53. The first-side check valve 80 is placed on a retard chamber 51 side of the bearing 2 in the retard passage 212. The first-side check valve 80 permits the hydraulic fluid to flow from the hydraulic pump 202 through the retard passage 212 into the retard chamber 51. Also, the first-side check valve 80 restricts, i.e., limits the hydraulic fluid to flow from the retard chamber 51 through the retard passage 212 back toward the hydraulic pump 202. The retard chamber 51, which connects to the retard passage 212 that has the first-side check valve 80, corresponds to a check valve connecting chamber of the present invention. Hereinafter, the retard chamber 51 may also be referred to as the control retard chamber 51. Additionally, each of the first-side check valve 80 and the second-side check valve 90, to be discussed later, corresponds to a phase check valve of the present invention.

The second-side check valve 90 is provided in the advance passage 222 among the advance passages 222, 223, 224, which are connected respectively to the advance chambers 55, 56, 57. The second-side check valve 90 is placed on an advance chamber 55 side of the bearing 2 in the advance passage 222. The second-side check valve 90 permits the hydraulic fluid to flow from the hydraulic pump 202 through the advance passage 222 into the advance chamber 55. Also, the second-side check valve 90 restricts, i.e., limits the hydraulic fluid to flow from the advance chamber 55 through the advance passage 222 back toward the hydraulic pump 202. The advance chamber 55, which connects to the advance passage 222 that has the second-side check valve 90, corresponds to a check valve connecting chamber of the present invention. Hereinafter, the advance chamber 55 may also be referred to as the control advance chamber 55.

Figure 6A:
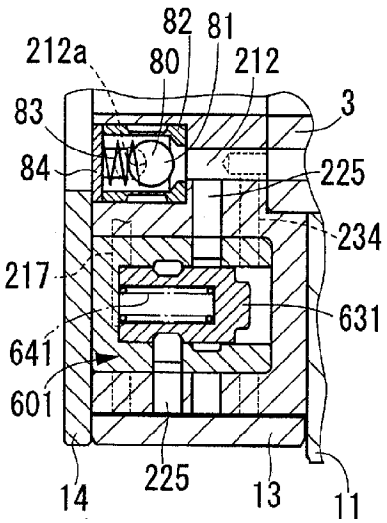
FIGS. 6A-6D are cross-sectional views illustrating an operation of a first-side check valve and a first-side control valve according to the first embodiment.
Figure 7A:
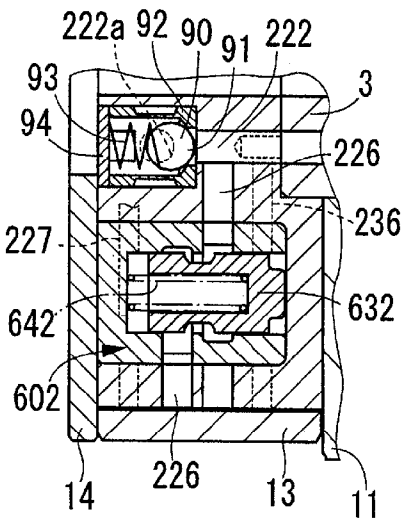
FIGS. 7A-7D are cross-sectional views illustrating an operation of a second-side check valve and a second-side control valve according to the first embodiment.

As shown in FIGS. 6A and 7A, each of the first-side check valve 80 and the second-side check valve 90 includes a valve body 81, 91, a valve seat 82, 92, a spring 83, 93, and a stopper 84, 94. Each spring 83, 93 is disposed between the stopper 84, 94 and the valve body 81, 91 to apply load to the valve body 81, 91 against the valve seat 82, 92.

With this configuration, when the hydraulic fluid is supplied from the hydraulic pump 202 to the control retard chamber 51 or the control advance chamber 55 through the retard passage 212 or the advance passage 222, the valve body 81, 91 is displaced toward the stopper 84, 94 against the load exerted by the spring 83, 93 to separate from the valve seat 82, 92, thereby causing the corresponding retard passage 212 or advance passage 222 to open. Then, the hydraulic fluid in the retard passage 212 flows into the control retard chamber 51 through a supply-only hydraulic passage, i.e., a dedicated hydraulic supply passage 212*a* (see FIGS. 3 and 6A-6D) of the retard passage 212, which connects between the first-side check valve 80 and the control retard chamber 51. Similarly, the hydraulic fluid in the advance passage 222 flows into the control advance chamber 55 through a supply-only hydraulic passage, i.e., a dedicated hydraulic supply passage 222*a* (see FIGS. 3 and 7A-7D) of the advance passage 222, which connects between the second-side check valve 90 and the control advance chamber 55.

When the hydraulic fluid is caused to flow from the control retard chamber 51 or the control advance chamber 55 toward the hydraulic pump 202, the spring 83, 93 pushes the valve body 81, 91 against the valve seat 82, 92, thereby causing the corresponding advance passage 222 or retard passage 212 to be blocked.

The retard passage 212 is connected with a first-side discharge passage 225, which bypasses the first-side check valve 80 and communicates with the retard passage 212. The first-side discharge passage 225 is provided with the first-side control valve 601. The first-side control valve 601 blocks the first-side discharge passage 225 when the retard control operation is executed to rotate the vane rotor 15 toward the retard side. Furthermore, the first-side control valve 601 opens the first-side discharge passage 225 when the advance control operation is executed to rotate the vane rotor 15 toward the advance side. When the first-side discharge passage 225 is opened, the hydraulic fluid in the control retard chamber 51 is discharged through the first-side discharge passage 225 and the retard passage 212 (see FIGS. 3 and 6A-6D). Accordingly, the first-side discharge passage 225 serves as a discharge-only hydraulic passage, i.e., a dedicated hydraulic discharge passage. Each of the first-side discharge passage 225 and a second-side discharge passage 226 (discussed later), which serves as a bypass discharge passage, corresponds to a fluid discharge passage of the present invention.

The first-side control valve 601 is a switch valve, which is driven by a pilot pressure. The pilot pressure is applied from the hydraulic pump 202 through the supply passage 230 and the retard pilot passage 234 to the first-side control valve 601. In the non-applied state of the pilot pressure where the hydraulic fluid is discharged from the retard pilot passage 234, and thereby no pilot pressure is applied to the first-side control valve 601, the spool 631, which serves as a valve member, is displaced by the load exerted by the spring 641, which serves as a resilient member. Thus, the first-side discharge passage 225 is opened. In contrast, in the applied state of the pilot pressure where the hydraulic fluid is supplied to the retard pilot passage 234, and thereby the pilot pressure is applied to the first-side control valve 601, the spool 631 of the first-side control valve 601 is displaced to the position shown in FIG. 1 against the load exerted by the spring 641. Thus, the first-side discharge passage 225 is blocked.

The advance passage 222 is connected with the second-side discharge passage 226, which bypasses the second-side check valve 90 and communicates with the advance passage 222. The second-side discharge passage 226 is provided with the second-side control valve 602. The second-side control valve 602 blocks the second-side discharge passage 226 when the advance control operation is executed to advance the vane rotor 15 toward the advance side. Furthermore, the second-side control valve 602 opens the second-side discharge passage 226 when the retard control operation is executed to rotate the vane rotor 15 toward the retard side. When the second-side discharge passage 226 is opened, the hydraulic fluid in the control advance chamber 55 is discharged through the second-side discharge passage 226 and the advance passage 222 (see FIGS. 3 and 7A-7D). Accordingly, the second-side discharge passage 226 serves as a discharge-only hydraulic passage, i.e., a dedicated hydraulic discharge passage.

The second-side control valve 602 is a switch valve, which is driven by a pilot pressure. The pilot pressure is applied from the hydraulic pump 202 through the supply passage 230 and the advance pilot passage 236 to the second-side control valve 602. In the non-applied state of the pilot pressure where the hydraulic fluid is discharged from the advance pilot passage 236, and thereby no pilot pressure is applied to the second-side control valve 602, a spool 632 is displaced to the position shown in FIG. 1 by the load exerted by a spring 642, which serves as a resilient member. Thus, the second-side discharge passage 226 is opened. In contrast, in the applied state of the pilot pressure where the hydraulic fluid is supplied to the advance pilot passage 236, and thereby the pilot pressure is applied to the second-side control valve 602, the spool 632, which serves as a valve member, of the second-side control valve 602 is displaced against the load exerted by the spring 642. Thus, the second-side discharge passage 226 is blocked.

The supply passage 230, the retard pilot passage 234, and the advance pilot passage 236, discussed above, correspond to pilot passages of the present invention.

The spring 641, 642 applies load to the spool 631, 632 to place the spool 631, 632 in the open position, at which the corresponding first-side discharge passage 225 or second-side discharge passage 226 is opened. Thus, in the non-applied state of the pilot pressure where no pilot pressure is applied to the control valve 601, 602, the corresponding first-side discharge passage 225 or second-side discharge passage 226 is normally open. That is, the first-side control valve 601 and the second-side control valve 602 of the first embodiment are so-called "normally open switch valves". A back pressure release passage 217, 227 is provided in a portion of the vane rotor 15 on the side where the spring 641, 642 is placed to apply load to the spool 631, 632 of the control valve 601, 602. The back pressure release passage 217, 227 releases back pressure, which changes when the spool 631, 632 slides.

The retard pilot passage 234 connects between the drain switch valve 600 and the first-side control valve 601, and the advance pilot passage 236 connects between the drain switch valve 600 and the second-side control valve 602. The drain switch valve 600 is switched to change a communication state of the retard pilot passage 234 and the advance pilot passage 236 relative to the supply passage 230 and the discharge passage 232. More specifically, the drain switch valve 600 realizes one of the following three selected states depending on the displaced position of the spool 630.

(1) The retard pilot passage 234 communicates with the supply passage 230, while the advance pilot passage 236 communicates with the discharge passage 232.

(2) Both of the retard pilot passage 234 and the advance pilot passage 236 communicate with the supply passage 230.

(3) The retard pilot passage 234 communicates with the discharge passage 232, while the advance pilot passage 236 communicates with the supply passage 230.

As shown in FIG. 2, the second-side check valve 90 and the second-side control valve 602 are received in the vane rotor 15. Additionally, although not shown in FIG. 2, the first-side check valve 80 and the first-side control valve 601 are also received in the vane rotor 15 in the same assembly structure as the second-side check valve 90 and the second-side control valve 602. In FIG. 2, the retard passage 211 and the advance passage 221 are omitted for the sake of simplicity. The retard pilot passage 234 and the advance pilot passage 236 extend from the drain switch valve 600 through the annular passages 244, 245 and extend in the camshaft 3 and in the boss portion 154 of the vane rotor 15, respectively.

Figure 4:
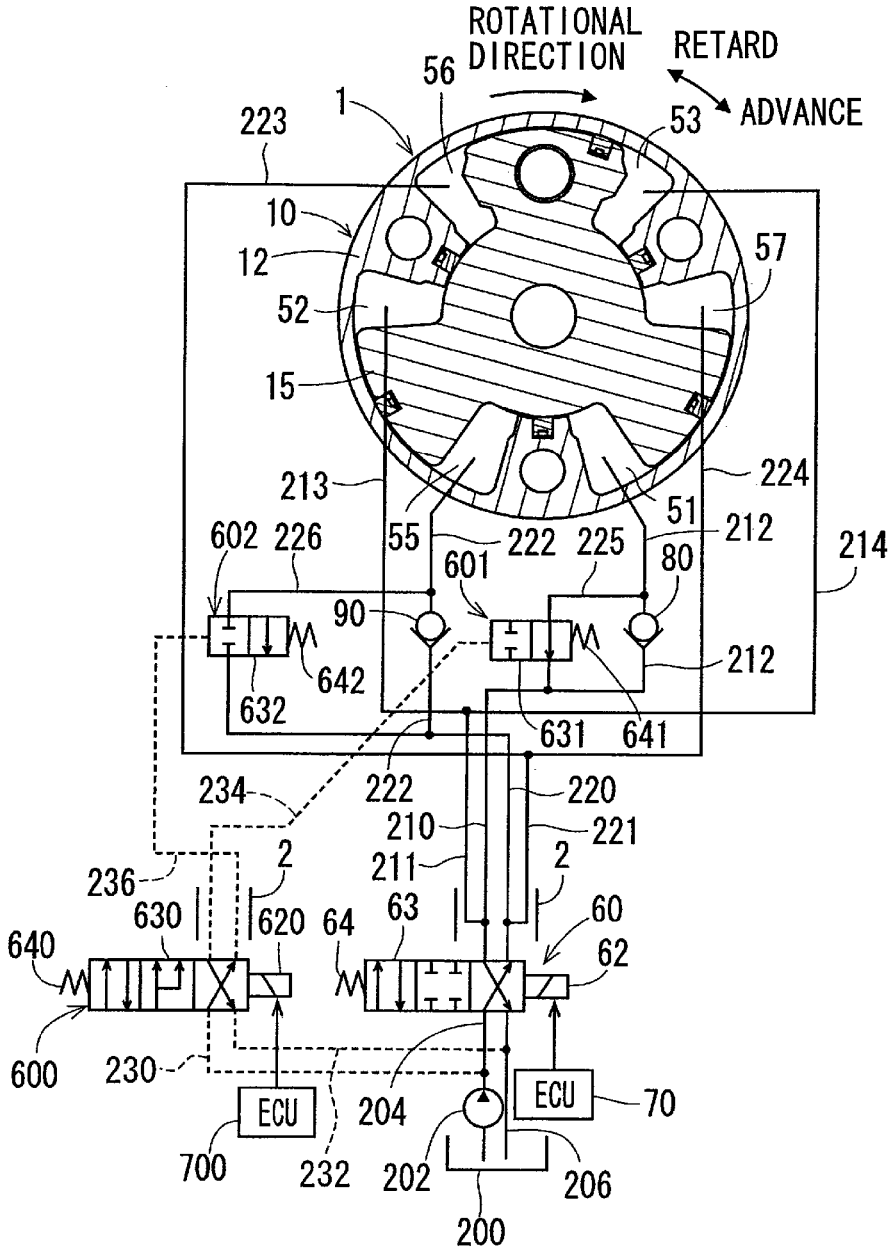
FIG. 4 is a schematic diagram illustrating the valve timing control system in an advance control operation according to the first embodiment.
Figure 5:
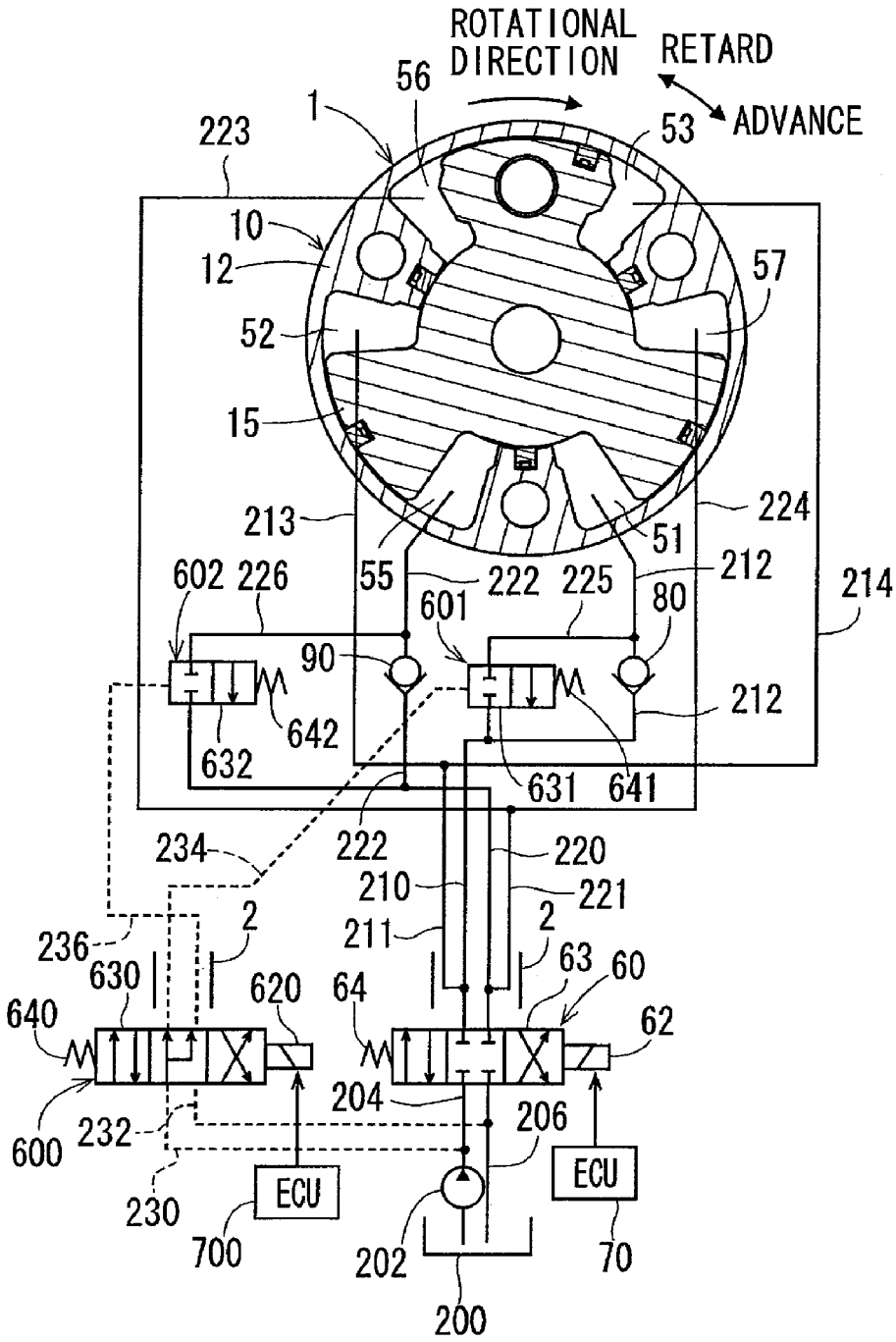
FIG. 5 is a schematic diagram illustrating the valve timing control system in an intermediate sustaining control operation according to the first embodiment.

Now, a description will be made to the operation of the vane rotor 15 and the phase switch valve 60 in the valve timing control system 1 with reference to FIGS. 1, 4 and 5. FIG. 1 shows the vane rotor 15 being actuated toward the retard side relative to the housing 10. FIG. 4 shows the vane rotor 15 being actuated toward the advance side relative to the housing 10. FIG. 5 shows the vane rotor 15 being retained so as not to rotate relative to the housing 10.

(Time of Stopping Internal Combustion Engine)

In the state where the internal combustion engine is stopped, the stopper piston 32 is fitted in the fit ring 34. Right after starting of the internal combustion engine, no hydraulic fluid is yet supplied from the hydraulic pump 202 to the retard chambers 51, 52, 53, the advance chambers 55, 56, 57, the hydraulic chamber 40, and the hydraulic chamber 42. Thus, the stopper piston 32 remains fitted in the fit ring 34, and the camshaft 3 is held in the most retarded position relative to the crankshaft. Thereby, until the hydraulic fluid is supplied to each hydraulic chamber, this allows for preventing the housing 10 and the vane rotor 15 from swinging or shaking to collide with each other due to variations in torque exerted on the camshaft and thereby generating rattle sound.

(After Starting Internal Combustion Engine)

Upon starting of the internal combustion engine, when a sufficient amount of hydraulic fluid is supplied from the hydraulic pump 202, the hydraulic pressure of the hydraulic fluid supplied to the hydraulic chamber 40 or the hydraulic chamber 42 causes the stopper piston 32 to be disconnected from the fit ring 34. Thus, the vane rotor 15 can freely rotate relative to the housing 10. Then, the phase difference of the camshaft relative to the crankshaft is adjusted by controlling the hydraulic pressure applied to each retard chamber and each advance chamber.

(Retard Control Operation)

When power supply to the phase switch valve 60 is turned off as shown in FIG. 1, the spool 63 is held in the position shown in FIG. 1 due to the load of the spring 64. In this state, the hydraulic fluid is supplied from the supply passage 204 to the retard passage 210. Also, the hydraulic fluid is supplied from the retard passage 211 to the retard passages 213, 214, which are branched from the retard passage 211, and thereby to the retard chambers 52, 53. Furthermore, the hydraulic fluid is supplied through the retard passage 212 to the retard chamber 51 through the first-side check valve 80.

Here, the retard passage 212, which supplies the hydraulic fluid to the retard chamber 51, is a dedicated passage, which connects between the retard passage 210 and the retard chamber 51. The retard passages 213, 214, which supply the hydraulic fluid to the retard chambers 52, 53, are branch passages, which are branched from the retard passages 211 that is the supply passage. Accordingly, the flow quantity of the hydraulic fluid per unit time supplied from the retard passage 212 to the retard chamber 51 is larger than the flow quantity of the hydraulic fluid per unit time supplied from the retard passage 213, 214 to the retard chamber 52, 53. Thus, the retard chamber 51 is filled with the hydraulic fluid earlier than, i.e., is filled with the hydraulic fluid at the faster rate (higher flow rate) than the retard chambers 52, 53 even when the pressure of the hydraulic fluid, which is supplied from the hydraulic pump 202, is relatively low.

In this state, the hydraulic fluid in the advance chambers 56, 57 is discharged through the advance passages 223, 224, the advance passage 221, the phase switch valve 60, and the discharge passage 206 to the oil pan 200. During the retard control operation, the second-side check valve 90 is closed, and the second-side control valve 602 opens the second-side discharge passage 226. Thus, the hydraulic fluid in the control advance chamber 55 bypasses the second-side check valve 90 and is then discharged to the oil pan 200 through the second-side discharge passage 226, the second-side control valve 602, the advance passage 220, the phase switch valve 60, and the discharge passage 206.

The hydraulic fluid is supplied to each retard chamber, and the hydraulic fluid from each advance chamber is discharged in this manner. Thereby, the vane rotor 15 receives the hydraulic fluid pressure from the three retard chambers 51, 52, 53, so that the vane rotor 15 rotates relative to the housing 10 toward the retard side.

As shown in FIG. 1, when the phase is changed to the target phase on the retard side by supplying the hydraulic fluid to each retard chamber and by discharging the hydraulic fluid from each advance chamber in the retard control operation, the vane rotor 15 receives the torque fluctuations relative to the housing 10 toward both of the retard side and the advance side due to the torque fluctuations applied to the camshaft 3. When the vane rotor 15 receives the torque fluctuation toward the advance side, the hydraulic fluid, which is supplied to each retard chamber, receives the force that causes discharge of the hydraulic fluid from the retard chamber into the retard passages 212, 213, 214.

However, in the first embodiment, the first-side check valve 80 is disposed in the retard passage 212, and the first-side control valve 601 blocks the first-side discharge passage 225 during the retard control operation. Thus, the discharge of the hydraulic fluid from the control retard chamber 51 to the retard passage 212 does not occur. Accordingly, in the state where the hydraulic pressure of the hydraulic pump 202 is relatively low, even when the vane rotor 15 receives the torque fluctuation toward the advance side, the vane rotor 15 is not returned toward the advance side relative to the housing 10.

As a result, the hydraulic fluid will not flow out of the retard chambers 52, 53 either. Accordingly, even when the vane rotor 15 receives the torque fluctuation from the camshaft toward the advance side, the vane rotor 15 can be prevented from returning toward the advance side, which is the side opposite from the target phase, relative to the housing 10. This allows the vane rotor 15 to quickly reach the target phase on the retard side.

As discussed above, at the time of supplying the hydraulic fluid to each retard chamber 51, 52, 53, the retard chamber 51, which is connected with the first-side check valve 80, is filled with the hydraulic fluid at the faster rate than the other retard chambers 52, 53. When the retard chamber 51 is filled with the hydraulic fluid, the first-side check valve 80 is closed because of the application of the torque fluctuation to the vane rotor 15 toward the advance side even when the pressure of the hydraulic fluid in the retard chamber 51 is relatively low. In this way, the hydraulic fluid is not discharged from the retard chamber 51, and the vane rotor 15 is not returned toward the advance side relative to the housing 10. Thus, even when the pressure of the hydraulic fluid, which is supplied from the hydraulic pump 202, is relatively low, the first-side check valve 80 can be quickly driven, and thereby the vane rotor 15 can quickly reach the target phase on the retard side.

When the vane rotor 15 receives the torque fluctuation toward the retard side and the advance side during the retard control operation, the pressure of the hydraulic fluid in each retard chamber changes irrespective of whether the hydraulic pressure of the hydraulic pump 202 is low or high. The pressure fluctuation of the hydraulic fluid in each retard chamber would be transmitted as pressure pulsation from the retard passage 213, 214 to the retard passage 210, the phase switch valve 60 and the supply passage 204. Here, when the vane rotor 15 receives the torque fluctuation, the pressure of the hydraulic fluid, which is on the retard chamber side or the advance chamber side of the phase switch valve 60, is increased relative to the pressure of the hydraulic fluid, which is on the hydraulic pump 202 side of the phase switch valve 60. Therefore, the pressure of the hydraulic fluid, which is on the retard chamber side or the advance chamber side of the phase switch valve 60, shows the greater change in comparison to the pressure of the hydraulic fluid, which is on the hydraulic pump 202 side of the phase switch valve 60. In contrast, the pressure of the hydraulic fluid, which is on the hydraulic pump 202 side of the phase switch valve 60, shows a smaller change in comparison the pressure of the hydraulic fluid, which is on the retard chamber side or the advance chamber side of the phase switch valve 60.

Thus, according to the first embodiment, the supply passage 230 is branched from the supply passage 204 on the hydraulic pump 202 side of the phase switch valve 60. The hydraulic fluid is supplied from the supply passage 230 to the retard pilot passage 234 or the advance pilot passage 236 through the drain switch valve 600, so that the pilot pressure is applied to the first-side control valve 601 or the second-side control valve 602. Therefore, even when the vane rotor 15 receives the torque fluctuation toward the retard side and the advance side at the time of executing the retard control operation, the pressure pulsation, which is transmitted to the retard pilot passage 234 that receives the hydraulic fluid from the supply passage 230 through the drain switch valve 600, can be reduced. In this context, even when the vane rotor 15 receives the torque fluctuation during the retard control operation, the pilot pressure, which is received from the retard pilot passage 234, allows the spool 631 of the first-side control valve 601 to keep the first-side discharge passage 225 blocked.

Furthermore, since the hydraulic fluid in each advance chamber and the advance pilot passage 236 is discharged to the oil pan 200 during the retard control operation, no pressure pulsation is conveyed to the second-side control valve 602 even when the vane rotor 15 receives the torque fluctuation during the retard control operation. Accordingly, the load exerted by the spring 642 allows the spool 632 of the second-side control valve 602 to keep the second-side discharge passage 226 open.

(Advance Control Operation)

Next, as shown in FIG. 4, when the power supply to the phase switch valve 60 is turned on, the spool 63 is placed in the position shown in FIG. 4 by the electromagnetic force of the solenoid drive arrangement 62, which is applied against the load exerted by the spring 64. In this state, the hydraulic fluid is supplied from the supply passage 204 to the advance passage 220. Also, the hydraulic fluid is supplied from the advance passage 221 to the advance passages 223, 224, which are branched from the advance passage 221, and thereby to the advance chambers 56, 57. Furthermore, the hydraulic fluid is supplied through the advance passage 222 to the advance chamber 55 through the second-side check valve 90.

Here, the advance passage 222, which supplies the hydraulic fluid to the advance chamber 55, is a dedicated passage, which connects between the advance passage 220 and the advance chamber 55. The advance passages 223, 224, which supply the hydraulic fluid to the advance chambers 56, 57, are branch passages, which are branched from the advance passage 221 that is the supply passage. Therefore, the flow quantity of the hydraulic fluid per unit time supplied from the advance passage 222 to the advance chamber 55 is larger than the flow quantity of the hydraulic fluid per unit time supplied from each of the advance passages 223, 224 to the corresponding advance chamber 56, 57. Thus, the advance chamber 55 is filled with the hydraulic fluid earlier than, i.e., at the faster rate than the advance chambers 56, 57 even when the pressure of the hydraulic fluid, which is supplied from the hydraulic pump 202, is relatively low.

In this state, the hydraulic fluid in the retard chambers 52, 53 is discharged through the retard passages 213, 214, the retard passage 211, the phase switch valve 60, and the discharge passage 206 to the oil pan 200. During the advance control operation, the first-side check valve 80 is closed, and the first-side control valve 601 opens the first-side discharge passage 225. Thus, the hydraulic fluid in the control retard chamber 51 bypasses the first-side check valve 80 and is then discharged to the oil pan 200 through the first-side discharge passage 225, the first-side control valve 601, the retard passage 210, the phase switch valve 60, and the discharge passage 206.

The hydraulic fluid is supplied to each advance chamber, and the hydraulic fluid from each retard chamber is discharged in this manner. Thereby, the vane rotor 15 receives the hydraulic fluid pressure from the three advance chambers 55 56, 57, so that the vane rotor 15 rotates relative to the housing 10 toward the advance side.

As shown in FIG. 4, when the phase is shifted to the target phase on the advance side by supplying the hydraulic fluid to each advance chamber and by discharging the hydraulic fluid from each retard chamber in the advance control operation, the vane rotor 15 receives the torque fluctuation toward the retard side and toward the advance side relative to the housing 10. When the vane rotor 15 receives the torque fluctuation toward the retard side, the hydraulic fluid in each advance chamber receives the force that causes discharge of the hydraulic fluid from the advance chamber into the advance passages 222, 223, 224.

Figure 13:
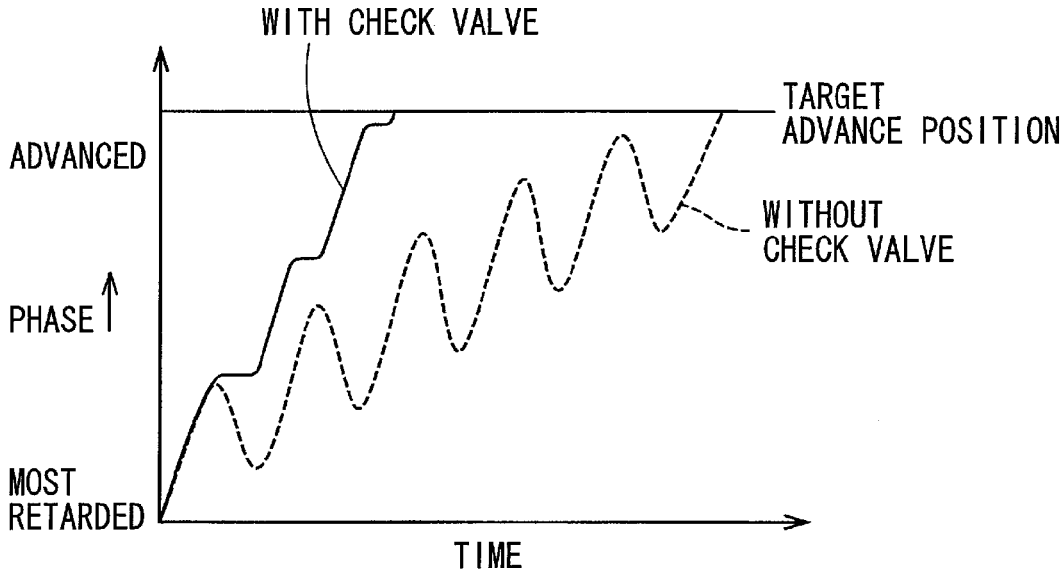
FIG. 13 is a characteristic diagram showing the time required to reach a target phase with and without a phase check valve.

However, in the first embodiment, the second-side check valve 90 is disposed in the advance passage 222, and the second-side control valve 602 blocks the second-side discharge passage 226 during the advance control operation. Thus, the discharge of the hydraulic fluid from the control advance chamber 55 to the advance passage 222 does not occur. Accordingly, in the state where the hydraulic pressure of the hydraulic pump 202 is relatively low, even when the vane rotor 15 receives the torque fluctuation toward the retard side, the vane rotor 15 is not returned toward the retard side relative to the housing 10. As a result, the hydraulic fluid does not flow out of the advance chamber 56, 57, either. Accordingly, as shown in FIG. 13, even when the vane rotor 15 receives the torque fluctuation from the camshaft toward the retard side, the vane rotor 15 can be prevented from returning toward the retard side, which is the side opposite from the target phase, relative to the housing 10. This allows the vane rotor 15 to quickly reach the target phase on the advance side.

As discussed above, at the time of supplying the hydraulic fluid to each advance chamber, the advance chamber 55, which is connected with the second-side check valve 90, is filled with the hydraulic fluid at the faster rate than the other advance chambers 56, 57. When the advance chamber 55 is filled with the hydraulic fluid, the second-side check valve 90 is closed because of the application of the torque fluctuation to the vane rotor 15 toward the retard side even when the pressure of the hydraulic fluid in the advance chamber 55 is relatively low. In this way, the hydraulic fluid is not discharged from the advance chamber 55, and the vane rotor 15 is not returned toward the retard side relative to the housing 10. Thus, even when the pressure of the hydraulic fluid, which is supplied from the hydraulic pump 202, is relatively low, the second-side check valve 90 can be quickly driven, and thereby the vane rotor 15 can quickly reach the target phase on the advance side.

When the vane rotor 15 receives the torque fluctuation toward the retard side and the advance side during the advance control operation, the pressure of the hydraulic fluid in each advance chamber changes irrespective of whether the hydraulic pressure of the hydraulic pump 202 is low or high. The pressure fluctuation of the hydraulic fluid in each advance chamber would be transmitted as pressure pulsation from the advance passages 223, 224 to the advance passage 220, the phase switch valve 60 and the supply passage 204. However, as discussed above, the supply passage 230 is branched from the supply passage 204 on the hydraulic pump 202 side of the phase switch valve 60. The hydraulic fluid is supplied from the supply passage 230 to the retard pilot passage 234 or the advance pilot passage 236 through the drain switch valve 600, so that the pilot pressure is applied to the first-side control valve 601 or the second-side control valve 602. Therefore, even when the vane rotor 15 receives the torque fluctuation toward the retard side and the advance side at the time of executing the advance control operation, the pressure pulsation, which is transmitted to the advance pilot passage 236 that receives the hydraulic fluid from the supply passage 230 through the drain switch valve 600, can be reduced. In this context, even when the vane rotor 15 receives the torque fluctuation during the advance control operation, the pilot pressure, which is received from the advance pilot passage 236, allows the spool 632 of the second-side control valve 602 to keep the second-side discharge passage 226 blocked.

Furthermore, since the hydraulic fluid in each retard chamber and the retard pilot passage 234 is discharged to the oil pan 200 during the advance control operation, no pressure pulsation is conveyed to the first-side control valve 601 even when the vane rotor 15 receives the torque fluctuation during the advance control operation. Accordingly, the load exerted by the spring 641 allows the spool 631 of the first-side control valve 601 to keep the first-side discharge passage 225 open.

(Intermediate Sustaining Control Operation)

As shown in FIG. 5, when the vane rotor 15 reaches the target phase, the ECU 70 controls the duty ratio of the drive current supplied to the phase switch valve 60 to retain the spool 63 at the intermediate position between the position shown in FIG. 1 and the position shown in FIG. 4. As a result, the phase switch valve 60 blocks the connections of the retard passage 210 and the advance passage 220 to the supply passage 204 and the discharge passage 206 to limit the discharge of the hydraulic fluid from each retard chamber and each advance chamber to the oil pan 200. Thus, the vane rotor 15 is sustained, i.e., is held in the target phase.

When the vane rotor 15 receives the torque fluctuation toward both of the retard side and the advance side during the intermediate sustaining control operation shown in FIG. 5, the pressure pulsation may possibly be transmitted to the supply passage 204 through the phase switch valve 60 due to the fact that the phase switch valve 60 is under the duty ratio control operation. However, the supply passage 230, which supplies the hydraulic fluid to the retard pilot passage 224 and the advance pilot passage 236, is branched from the supply passage 204 on the hydraulic pump 202 side of the phase switch valve 60, so that the pressure pulsation, which is transmitted to the drain switch valve 600, can be reduced. Thus, it is possible to prevent the fluctuation of the position of the spool 631 of the first-side control valve 601 and the spool 632 of the second-side control valve 602.

Furthermore, at the time of executing the intermediate sustaining control operation, the spool 63 of the phase switch valve 60 blocks the retard passage 210 and the advance passage 220. Thus, when the vane rotor 15 receives the torque fluctuation, the phase switch valve 60 blocks the conduction of the pressure pulsation from the retard chamber side and the advance chamber side to the phase switch valve 60. In this way, the fluctuation of the pilot pressure can be reduced, so that the first-side control valve 601 and the second-side control valve 602 can keep the retard pilot passage 234 and the advance pilot passage 236 in the blocked state.

Now, referring to FIGS. 6A to 7D, a description will be made to the operation of the first-side check valve 80 and the operation the second-side check valve 90 as well as the operation of the first-side control valve 601 and the operation of the second-side control valve 602 during the retard control operation (retard time), the advance control operation (advance time), and the intermediate sustaining control operation (intermediate sustaining time), discussed above. FIGS. 6A-6D are cross-sectional views illustrating the operation of the first-side check valve 80 and the operation of the first-side control valve 601, which are connected to the control retard chamber 51. FIGS. 7A-7D are cross-sectional views illustrating the operation of the second-side check valve 90 and the operation of the second-side control valve 602, which are connected to the control advance chamber 55.

(Retard Control Operation)

During the retard control operation, the second-side control valve 602 and the phase switch valve 60 are switched into the state, in which the hydraulic fluid is discharged from each advance chamber. Thus, as shown in FIG. 7A, the second-side check valve 90 blocks the advance passage 222 irrespective of whether the torque, which is received by the vane rotor 15 in the retard control operation, is advance torque (negative torque) or retard torque (positive torque). This prevents backflow from the supply-only hydraulic passage 222*a* to the advance passage 222. Furthermore, the load, which is exerted by the spring 642, causes the second-side control valve 602 to open the second-side discharge passage 226, thereby allowing the hydraulic fluid to flow out of the control advance chamber 55 through the second-side discharge passage 226.

Additionally, during the retard control operation, hydraulic fluid is supplied from the retard passage 210 and the retard passage 211 to the retard passages 212, 213, 214. Thus, when the vane rotor does not receive the positive and negative torque fluctuations, the first-side check valve 80 opens the retard passage 212, so that hydraulic fluid is supplied from the retard passage 212 to the control retard chamber 51 through the supply-only hydraulic passage 212*a*.

As shown in FIG. 6A, when the vane rotor receives the retard torque fluctuation (positive torque) on the retard side during the retard control operation, the first-side check valve 80 also opens the retard passage 212. Furthermore, the pilot pressure causes the first-side control valve 601 to block the first-side discharge passage 225, thereby restricting the hydraulic fluid to flow out of the control retard chamber 51 through the first-side discharge passage 225.

Figure 6B:
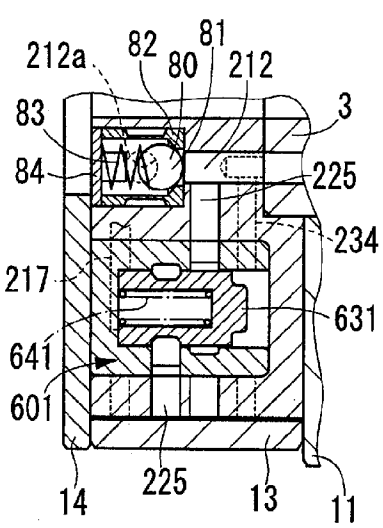

On the other hand, as shown in FIG. 6B, when the vane rotor 15 receives the negative torque on the advance side during the retard control operation, the first-side check valve 80 blocks the retard passage 212, thereby preventing backflow from the supply-only hydraulic passage 212*a* to the retard passage 212. Furthermore, the pilot pressure causes the first-side control valve 601 to block the first-side discharge passage 225, thereby restricting the hydraulic fluid to flow out of the control retard chamber 51 through the first-side discharge passage 225.

(Advance Control Operation)

Figure 6C:
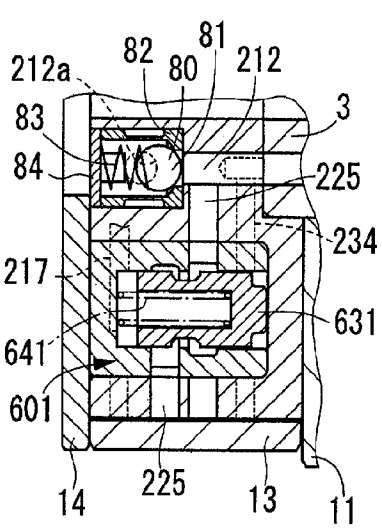

During the advance control operation, the first-side control valve 601 and the phase switch valve 60 are switched to the state, in which the hydraulic fluid is discharged from each retard chamber. Thus, as shown in FIG. 6C, the first-side check valve 80 blocks the retard passage 212 irrespective of whether the torque fluctuation, which is received by the vane rotor 15 during the advance control operation is caused by negative torque or positive torque. This prevents backflow from the supply-only hydraulic passage 212*a* to the retard passage 212. Furthermore, the load, which is exerted by the spring 641, causes the first-side control valve 601 to open the first-side discharge passage 225, thereby allowing the hydraulic fluid to flow out of the control retard chamber 51 through the first-side discharge passage 225.

Additionally, during the advance control operation, hydraulic fluid is supplied from the advance passage 220 and the advance passage 221 to the advance passages 222, 223, 224. Thus, when the vane rotor does not receive the positive and negative torque fluctuations, the second-side check valve 90 opens the advance passage 222, so that hydraulic fluid is supplied from the advance passage 222 to the control advance chamber 55 through the supply-only hydraulic passage 222*a*.

Figure 7B:
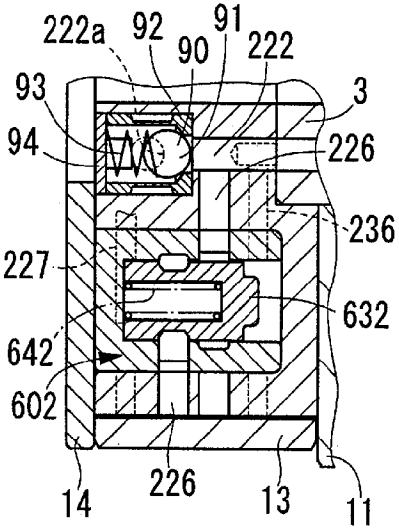
Figure 7C:
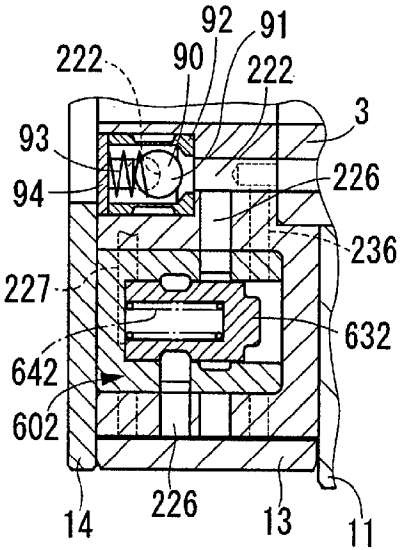

As shown in FIG. 7C, when the vane rotor receives the advance torque fluctuation (negative torque) on the advance side during the advance control operation, the second-side check valve 90 also opens the advance passage 222. Furthermore, the pilot pressure causes the second-side control valve 602 to block the second-side discharge passage 226, thereby restricting the hydraulic fluid to flow out of the control advance chamber 55 through the second-side discharge passage 226.

On the other hand, as shown in FIG. 7B, when the vane rotor 15 receives the positive torque on the retard side during the advance control operation, the second-side check valve 90 blocks the advance passage 222, thereby preventing backflow from the supply-only hydraulic passage 222*a* to the advance passage 222. Furthermore, the pilot pressure causes the second-side control valve 602 to block the second-side discharge passage 226, thereby restricting the hydraulic fluid to flow out of the control advance chamber 55 through the second-side discharge passage 226.

(Intermediate Sustaining Control Operation)

Figure 7D:
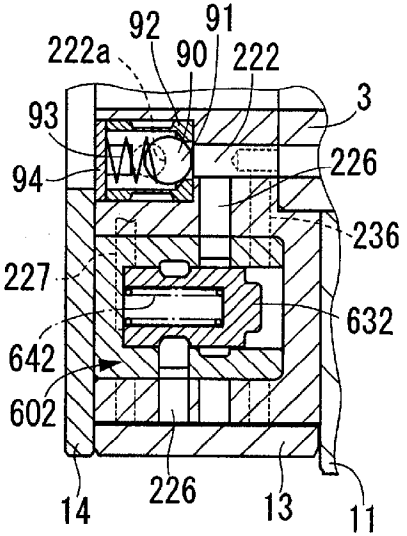

As shown in FIG. 7D, when the vane rotor 15 receives the positive torque or the negative torque during the intermediate sustaining control operation, the second-side check valve 90 blocks the advance passage 222, thereby preventing backflow from the supply-only hydraulic passage 222*a* to the advance passage 222. Furthermore, the pilot pressure causes the second-side control valve 602 to block the second-side discharge passage 226 against the load exerted by the spring 642, thereby restricting the hydraulic fluid to flow out of the control advance chamber 55 through the second-side discharge passage 226.

Figure 6D:
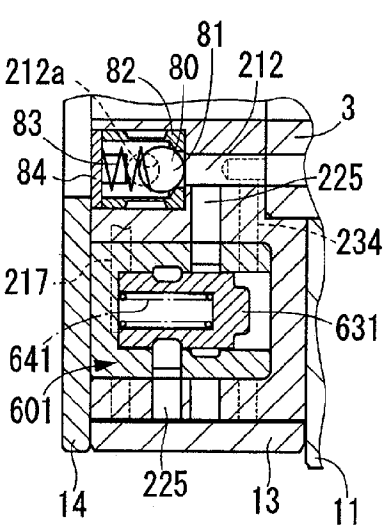

As shown in FIG. 6D, when the vane rotor 15 receives the positive torque or the negative torque during the intermediate sustaining control operation, the first-side check valve 80 blocks the retard passage 212, thereby preventing backflow from the supply-only hydraulic passage 212*a* to the retard passage 212. Furthermore, the pilot pressure causes the first-side control valve 601 to block the first-side discharge passage 225 against the load exerted by the spring 641, thereby restricting the hydraulic fluid to flow out of the control retard chamber 51 through the first-side discharge passage 225.

According to the first embodiment, the first-side check valve 80 is disposed in the retard passage 212, and the second-side check valve 90 is disposed in the advance passage 222. Furthermore, during the intermediate sustaining control operation, the first-side discharge passage 225 is blocked by the first-side control valve 601, and the second-side discharge passage 226 is blocked by the second-side control valve 602. Thereby, even when the vane rotor 15 receives the torque fluctuation toward both the retard side and the advance side in the intermediate sustaining control operation for holding the vane rotor 15 in the target phase, the working fluid can be prevented from flowing out of the control retard chamber 51 and the control advance chamber 55. Thus, even when the vane rotor 15 receives the torque fluctuation toward both the retard side and the advance side during the intermediate sustaining control operation, the vane rotor 15 is not returned to the retard side nor the advance side relative to the housing 10. As a result, the hydraulic fluid does not flow out of the retard chamber 52, 53 and the advance chamber 56, 57. It is thus possible to prevent the relative rotation of the vane rotor 15 toward the retard side and the advance side during the intermediate sustaining control operation, thereby limiting a deviation in the valve timing of the intake valve.

Furthermore, in the first embodiment, the phase switch valve 60 is placed on the hydraulic pump 202 side of the bearing 2, and the first-side check valve 80, the second-side check valve 90, the first-side control valve 601 and the second-side control valve 602 are placed on the retard chamber side and the advance chamber side of the bearing 2. Thus, when the vane rotor 15 receives the torque fluctuation, leakage of the hydraulic fluid from the retard chamber or the advance chamber through the bearing can be limited, and suction of air through a slide clearance of the bearing can be limited.

Also, since the first-side check valve 80, the second-side check valve 90, the first-side control valve 601 and the second-side check valve 606 are received in the vane rotor 15, the passage length between the first-side check valve 80 and the retard chamber 51 and the passage length between the second-side check valve 90 and the advance chamber 55 become relatively short. Thus, a dead volume, which is formed by the passage between the first-side check valve 80 and the retard chamber 51 and the passage between the second-side check valve 90 and the advance chamber 55, is reduced. Therefore, even when the vane rotor 15 receives the torque fluctuation, the reduction of the pressure in the retard chamber 51 or the advance chamber 55, to which the hydraulic pressure is supplied, can be limited. As a result, the response in the phase control operation is improved.

Second Embodiment

The first embodiment employs the first-side control valve 601 and the second-side control valve 602 of the normally open type as the drain control valves. In contrast, a valve timing control system 4 according to a second embodiment employs a first-side control valve 801 and a second-side control valve 810 of a normally closed type shown in FIGS. 8 to 10D as the drain control valves. Furthermore, in the second embodiment, a drain switch valve 820 is configured differently from the drain switch valve 600 of the first embodiment because of the use of the first-side and second-side control valves 801, 810 of the normally closed type. The other components of the valve timing control system 4 according to the second embodiment are substantially the same as those of the valve timing control system 1 of the first embodiment.

More specifically, in the first-side control valve 801 and the second-side control valve 810, the two springs 641, 642 apply load to a spool 802 of the first-side control valve 801 and a spool 812 of the second-side control valve 810 to block the first-side discharge passage 225 and the second-side discharge passage 226, respectively. Thus, in the non-applied state of the pilot pressure where no pilot pressure is applied to both the control valves 801, 810, the first-side discharge passage 225 and the second-side discharge passage 226 are normally blocked.

Now, there will be described the control operation of the pilot pressure, which is applied to the first-side control valve 801 and the second-side control valve 810 in the switching control operation of the drain switch valve 820 during the phase control operation.

(Retard Control Operation)

Figure 8:
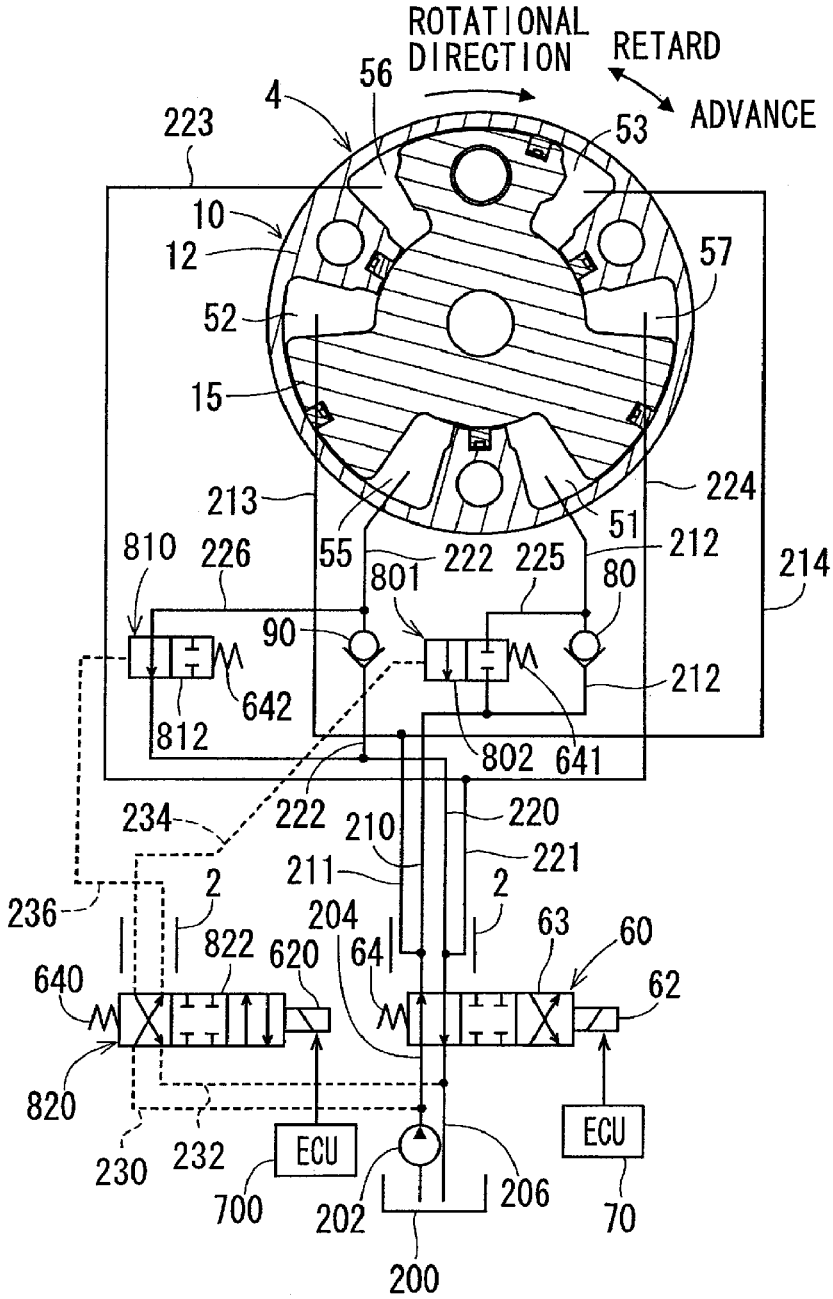
FIG. 8 is a schematic diagram illustrating a valve timing control system in a retard control operation according to a second embodiment of the present invention.
Figure 9A:
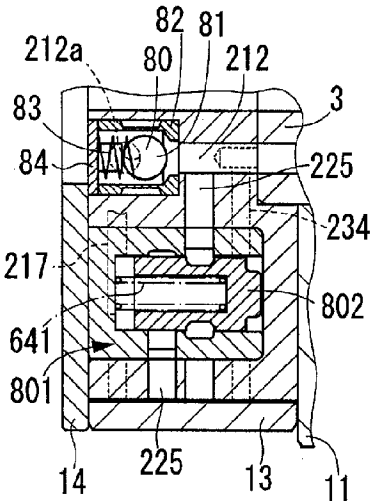
FIGS. 9A-9D are cross-sectional views illustrating an operation of a first-side check valve and a first-side control valve according to the second embodiment.
Figure 9B:
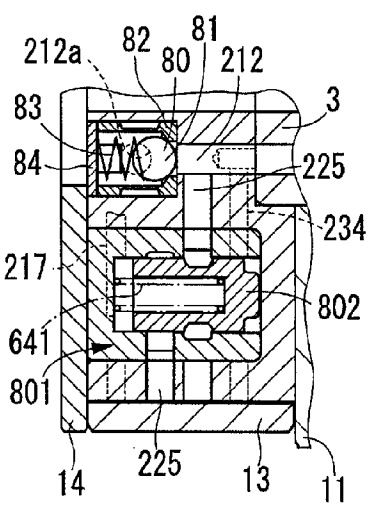
Figure 9C:
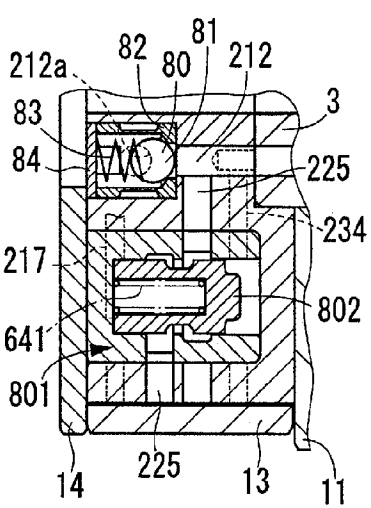
Figure 9D:
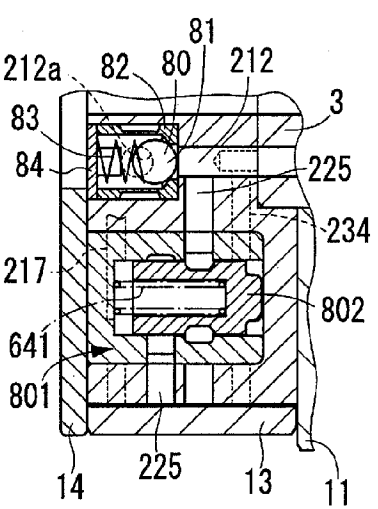
Figure 10A:
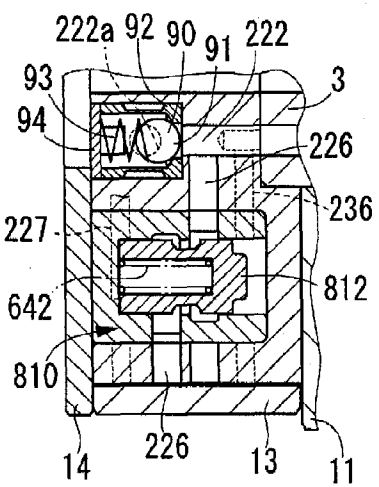
FIG. 10A-10D are cross-sectional views illustrating an operation of a second-side check valve and a second-side control valve according to the second embodiment.
Figure 10B:
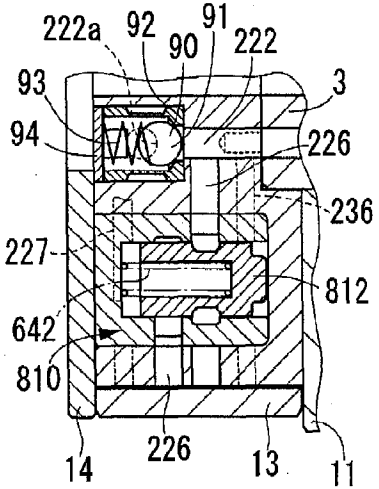
Figure 10C:
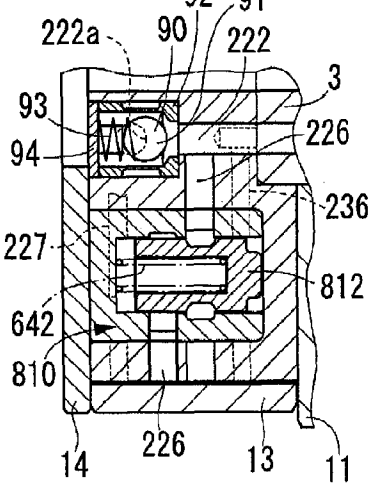
Figure 10D:
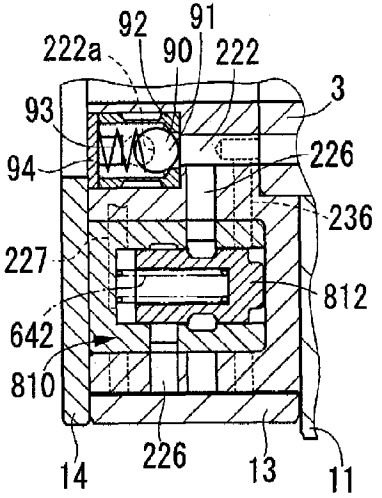

During the retard control operation, power supply to the solenoid drive arrangement 620 is turned off, and thus a spool 822 of the drain switch valve 820 is in the position shown in FIG. 8. In this state, the hydraulic fluid is supplied from the hydraulic pump 202 to the advance pilot passage 236, thereby causing the pilot pressure to be applied to the second-side control valve 810. In contrast, the hydraulic fluid is discharged from the retard pilot passage 234, so that the pilot pressure is not applied to the first-side control valve 801.

(Advance Control Operation)

The hydraulic fluid is supplied from the drain switch valve 820 to the retard pilot passage 234, so that the pilot pressure is applied to the first-side control valve 801. In contrast, the hydraulic fluid is discharged from the advance pilot passage 236 through the drain switch valve 820, so that the pilot pressure is not applied to the second-side control valve 810.

(Intermediate Sustaining Control Operation)

The drain switch valve 820 blocks the supply of the hydraulic fluid to the retard pilot passage 234 and the advance pilot passage 236, so that the pilot pressure is not applied to the first-side control valve 801 and the second-side control valve 810.

As described above, the second embodiment is different from the first embodiment in terms of the controlling of the pilot pressure through the drain switch valve 820. However, as shown in FIGS. 9 and 10, during the phase control operation (e.g., the retard control operation, the advance control operation, the intermediate sustaining control operation), the open/closed state of the first-side discharge passage 225 caused by the first-side control valve 801 and the open/closed state of the second-side discharge passage 226 caused by the second-side control valve 802 are similar to those of FIGS. 6 and 7 of the first embodiment.

Third and Fourth Embodiments

Figure 11:
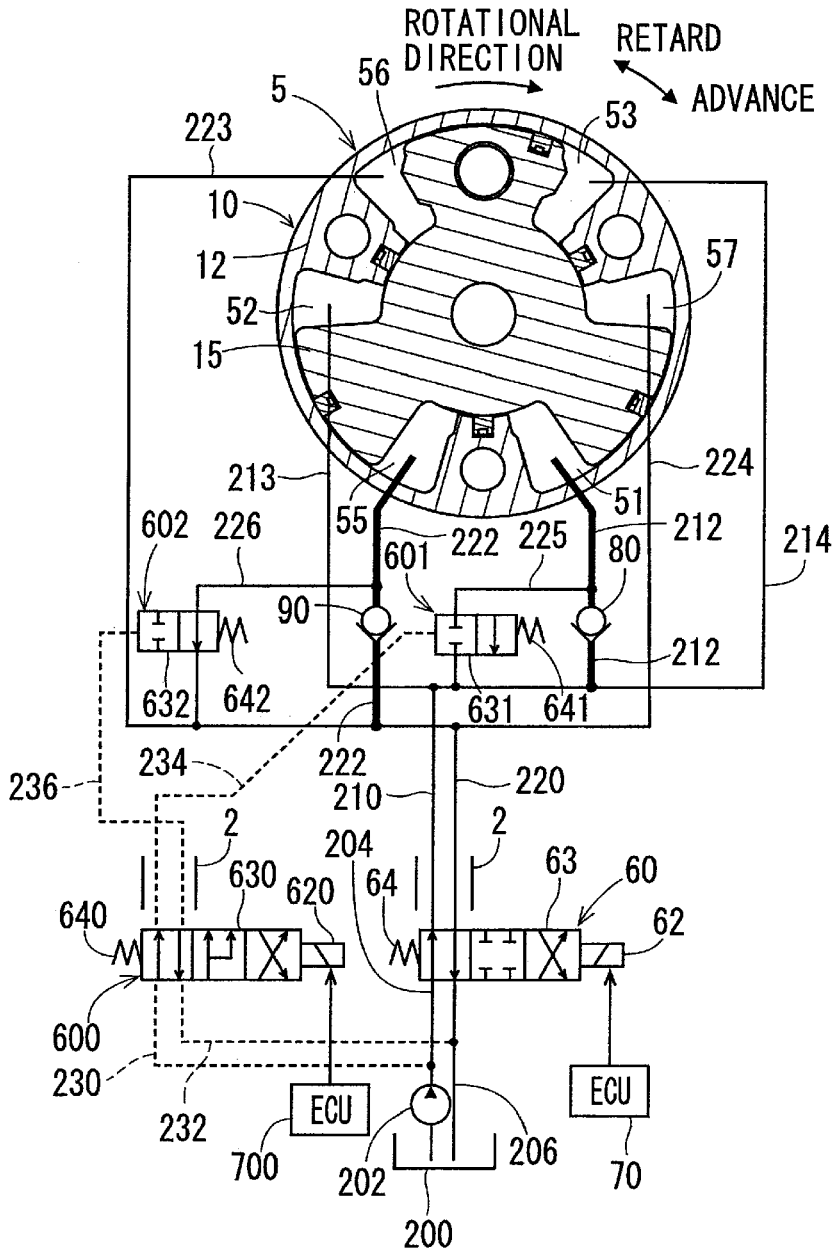
FIG. 11 is a schematic diagram illustrating a valve timing control system in a retard control operation according to a third embodiment of the present invention.
Figure 12:
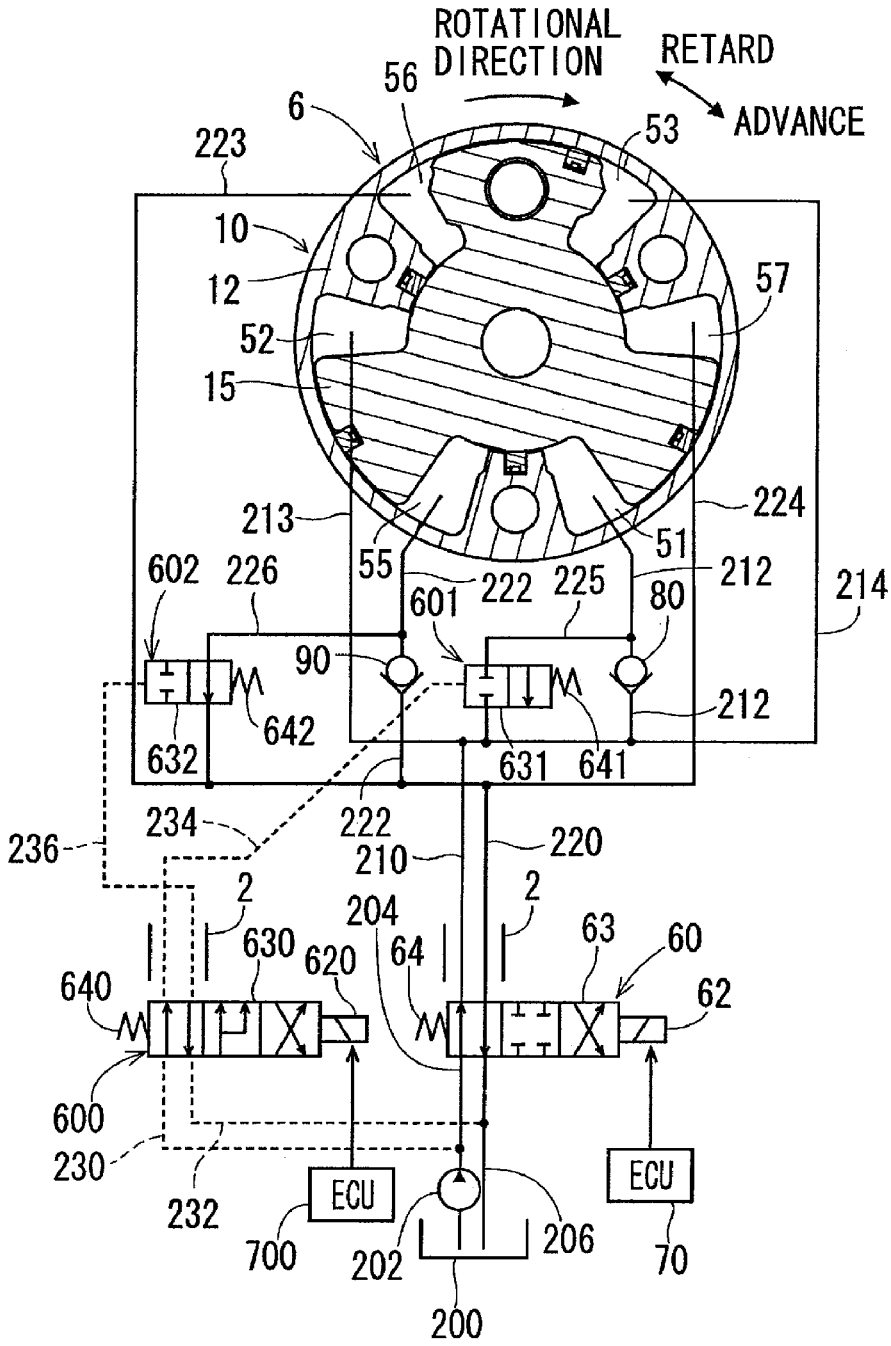
FIG. 12 a schematic diagram illustrating a valve timing control system in a retard control operation according to a fourth embodiment.

FIG. 11 shows a third embodiment of the present invention, and FIG. 12 shows a fourth embodiment of the present invention. The components similar to those of the above embodiment(s) will be indicated by the same numerals.

In the valve timing control system 5, 6 in each of the third and fourth embodiments, the retard passages 212, 213, 214 are branched from the retard passage 210.

With the above construction of the retard passages, according to the third embodiment, a passage cross sectional area of the retard passage 212, which is connected to the retard chamber 51 and is provided with the first-side check valve 80, is larger than that of the other retard passages 213, 214. In contrast, with the above construction of the retard passages, in the valve timing control system 6 of the fourth embodiment, a passage length of the retard passage 212, which is connected to the retard chamber 51 and is provided with the first-side check valve 80, is shorter than that of the other retard passages 213, 214.

With the above construction of the retard passages, according to the third and fourth embodiments, the pressure loss of the retard passage 212 is smaller than that of the other retard passages 213, 214. Therefore, the flow quantity of the hydraulic fluid per unit time supplied from the retard passage 212 to the retard chamber 51 is larger than the flow quantity of the hydraulic fluid per unit time supplied from each of the retard passages 213, 214 to the corresponding retard chamber 52, 53. As a result, even when the pressure of the hydraulic fluid, which is supplied from the hydraulic pump 202, is relatively low, the retard chamber 51 can be filled with the hydraulic fluid at the faster rate.

Therefore, according to the third and fourth embodiments, even when the pressure of hydraulic fluid in the retard chamber 51 is relatively low, the first-side check valve 80 is closed because of the application of the torque fluctuation to the vane rotor 15 toward the advance side. In this way, the hydraulic fluid is not discharged from the retard chamber 51, and the vane rotor 15 is not returned toward the advance side relative to the housing 10. Thus, even when the pressure of the hydraulic fluid, which is supplied from the hydraulic pump 202, is relatively low, the first-side check valve 80 can be quickly driven, and thereby the vane rotor 15 can quickly reach the target phase on the retard side.

Furthermore, in the valve timing control system 5, 6 of each of the third and fourth embodiments, the advance passages 222, 223, 224 are branched from the advance passage 220.

With the above construction of the advance passages, according to the third embodiment, a passage cross sectional area of the advance passage 222, which is connected to the advance chamber 55 and is provided with the second-side check valve 90, is larger than that of the other advance passages 223, 224. In contrast, with the above construction of the advance passages, in the valve timing control system 6 of the fourth embodiment, a passage length of the advance passage 222, which is connected to the advance chamber 55 and is provided with the second-side check valve 90, is shorter than that of the other advance passages 223, 224.

With the above construction of the advance passages, according to the third and fourth embodiments, the pressure loss of the advance passage 222 is smaller than that of the other advance passages 223, 224. Therefore, the flow quantity of the hydraulic fluid per unit time supplied from the advance passage 222 to the advance chamber 55 is larger than the flow quantity of the hydraulic fluid per unit time supplied from each of the advance passages 223, 224 to the corresponding advance chamber 56, 57. As a result, even when the pressure of the hydraulic fluid, which is supplied from the hydraulic pump 202, is relatively low, the advance chamber 55 can be filled with the hydraulic fluid at the faster rate.

Therefore, according to the third and fourth embodiments, even when the pressure of hydraulic fluid in the advance chamber 55 is relatively low, the second-side check valve 90 is closed because of the application of the torque fluctuation to the vane rotor 15 toward the retard side. In this way, the hydraulic fluid is not discharged from the advance chamber 55, and the vane rotor 15 is not returned toward the retard side relative to the housing 10. Thus, even when the pressure of the hydraulic fluid, which is supplied from the hydraulic pump 202, is relatively low, the second-side check valve 90 can be quickly driven, and thereby the vane rotor 15 can quickly reach the target phase on the advance side.

Other Embodiments

In the aforementioned embodiments, the retard chamber and the advance chamber are connected with the first-side check valve 80 and the second-side check valve 90, respectively, which serve as the phase check valves, and are also connected with the first-side control valve and the second-side control valve, respectively, which serve as the drain control valves, respectively. Alternatively, one of the retard chamber and the advance chamber may be connected with the phase check valve and the drain control valve.

Additionally, in the aforementioned embodiments, only the retard passage 212 among the plurality of retard passages 212, 213, 214 has the first-side check valve 80. However, it is only required that the first-side check valve 80 is installed in at least one of the plurality of retard passages 212, 213, 214. For example, the first-side check valve 80 may be installed in each of all the retard passages 212, 213, 214. Even in this case, at least one of the retard passages 212, 213, 214 may be formed to have the smaller pressure loss and thereby to implement a larger flow quantity of the hydraulic fluid in comparison to the rest of the retard passages 212, 213, 214, and the at least one first-side check valve 80 may be provided in the at least one of the retard passages 212, 213, 214.

Additionally, in the aforementioned embodiments, only the advance passage 222 among the plurality of advance passages 222, 223, 224 has the second-side check valve 90. However, it is only required that the second-side check valve 90 is installed in at least one of the plurality of advance passages 222, 223, 224. For example, the second-side check valve 90 may be installed in each of all the advance passages 222, 223, 224. Even in this case, at least one of the advance passages 222, 223, 224 may be formed to have the smaller pressure loss and thereby to implement a larger flow quantity of the hydraulic fluid in comparison to the rest of the advance passages 222, 223, 224, and the at least one second-side check valve 90 may be provided in the at least one of the advance passages 222, 223, 224.

In the aforementioned embodiments, the phase check valve and the drain control valve are installed in the vane rotor 15 on the side of the bearing 2 where the advance chambers and the retard chambers are located. In contrast to this, the phase check valve and the drain control valve may be installed outside the vane rotor 15. Alternatively, the phase check valve and the drain control valve may be installed on the hydraulic pump 202 side of the bearing 2.

In the aforementioned embodiments, the present invention is applied in the valve timing control system of the intake valve. Alternatively, the present invention may also be applied to a valve timing control system for adjusting the valve timing of the exhaust valve or both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing control system installed in a drive transmission system that transmits a drive force from a drive shaft of an internal combustion engine to a follower shaft, which opens and closes at least one of an intake valve and an exhaust valve of the internal combustion engine, so that the valve timing control system adjusts opening and closing timing of the at least one of the intake valve and the exhaust valve, the valve timing control system comprising:

a housing that is rotated together with one of the drive shaft and the follower shaft and has at least three receiving chambers, each of which is formed within a predetermined angular range in a rotational direction;

a vane rotor that is rotated together with the other one of the drive shaft and the follower shaft and has at least three vanes, each of which is received in a corresponding one of the at least three receiving chambers to partition the receiving chamber into a corresponding retard chamber and a corresponding advance chamber, wherein the vane rotor is driven to rotate in a corresponding one of a retard side and an advance side relative to the housing by a pressure of working fluid in a corresponding one of each retard chamber and each advance chamber of the at least three receiving chambers, so that a relative phase of the vane rotor relative to the housing is controlled;

a passage arrangement that includes:

a group of at least three retard passages, each of which connects between a fluid source side and a corresponding one of the retard chambers of the at least three receiving chambers; and a group of at least three advance passages, each of which connects between the fluid source side and a corresponding one of the advance chambers of the at least three receiving chambers;

at least one phase check valve that is installed in at least one predetermined passage, respectively, which is selected from the group of at least three retard passages and the group of at least three advance passages, wherein each phase check valve limits the working fluid to flow from a corresponding check valve connecting chamber, which is a corresponding one of the retard chambers and the advance chambers of the at least three receiving chambers connected to the phase check valve, toward the fluid source, while the phase check valve permits the working fluid to flow from the fluid source to the corresponding check valve connecting chamber; and at least one drain control valve, each of which is driven by a pilot pressure exerted by the working fluid from the fluid source and is installed in a corresponding one of at least one fluid discharge passage, which is provided separately from the group of at least three retard passages and the group of at least three advance passages to discharge the working fluid from the check valve connecting chamber that is associated with a corresponding one of the at least one phase check valve, wherein:

each drain control valve blocks the corresponding fluid discharge passage when the working fluid is supplied from the fluid source to the check valve connecting chamber associated with the corresponding one of the at least one phase check valve to rotate the vane rotor in a corresponding one of the retard side and the advance side relative to the housing; and the drain control valve opens the corresponding fluid discharge passage when the working fluid is discharged from the check valve connecting chamber associated with the corresponding one of the at least one phase check valve to rotate the vane rotor in the other one of the retard side and the advance side relative to the housing; and each of the at least one predetermined passage is a dedicated passage connected to the corresponding one of the retard chambers and the advance chambers of the at least three receiving chambers while remaining two or more of the at least three retard passages or the at least three advance passages of the same group, from which the predetermined passage is selected, are branched from a corresponding common passage that is connected to the fluid source side.

2. The valve timing control system according to claim 1, wherein a passage cross sectional area of each of the at least one predetermined passage is set to be larger than that of remaining two or more of the at least three retard passages and the at least three advance passages of the same group, from which the predetermined passage is selected.

3. The valve timing control system according to claim 1, wherein a passage length of each of the at least one predetermined passage is set to be smaller than that of remaining two or more of the at least three retard passages or the at least three advance passages, from which the predetermined passage is selected.

4. The valve timing control system according to claim 1, wherein the at least one predetermined passage is a single predetermined passage, which contains the corresponding phase check valve as a single phase check valve therein, in a corresponding one of the group of at least three retard passages and the group of at least three advance passages.

5. The valve timing control system according to claim 1, wherein:

the at least one phase check valve includes:

at least one first-side check valve that is installed in the group of at least three retard passages to permit the working fluid to flow from the fluid source side to the retard chamber of the corresponding one of the at least three receiving chambers and to limit the working fluid to flow from the retard chamber of the corresponding one of the at least three receiving chambers to the fluid source side; and at least one second-side check valve that is installed in the group of at least three advance passages to permit the working fluid to flow from the fluid source side to the advance chamber of the corresponding one of the at least three receiving chambers and to limit the working fluid to flow from the advance chamber of the corresponding one of the at least three receiving chambers to the fluid source side;

the at least one fluid discharge passage includes:

at least one first-side discharge passage, each of which discharges the working fluid from the retard chamber of the corresponding one of the at least three receiving chambers; and at least one second-side discharge passage, each of which discharges the working fluid from the advance chamber of the corresponding one of the at least three receiving chambers; and the at least one drain control valve includes:

at least one first-side control valve, each of which is installed in a corresponding one of the at least one first-side discharge passage, wherein each first-side control valve blocks the corresponding first-side discharge passage at a time of executing a retard control operation for rotating the vane rotor in the retard side and opens the corresponding first-side discharge passage at a time of executing an advance control operation for rotating the vane rotor in the advance side; and at least one second-side control valve, each of which is installed in a corresponding one of the at least one second-side discharge passage, wherein each second-side control valve blocks the corresponding second-side discharge passage at the time of executing the advance control operation for rotating the vane rotor in the advance side and opens the corresponding second-side discharge passage at the time of executing the retard control operation for rotating the vane rotor in the retard side.

6. The valve timing control system according to claim 1, further comprising a phase switch valve that is switched to implement:

one of supplying of the working fluid from the fluid source to the retard chambers of the at least three receiving chambers and discharging of the working fluid from the retard chambers of the at least three receiving chambers; and one of supplying of the working fluid from the fluid source to the advance chambers of the at least three receiving chambers and discharging of the working fluid from the advance chambers of the at least three receiving chambers, wherein:

the group of at least three retard passages connects between the phase switch valve and the retard chambers of the at least three receiving chambers;

the group of at least three advance passages connects between the phase switch valve and the advance chambers of the at least three receiving chambers; and each fluid discharge passage, in which the corresponding drain control valve is installed, bypasses a corresponding one of the at least one phase check valve and connects the corresponding check valve connecting chamber, which is associated with the corresponding one of the at least one phase check valve, to the phase switch valve.

7. The valve timing control system according to claim 6, further comprising a drain switch valve that is installed in at least one pilot passage, which is branched from a supply passage that supplies the working fluid from the fluid source to the phase switch valve, and which is connected to the at least one drain control valve to apply the pilot pressure to the at least one drain control valve by the working fluid supplied from the fluid source, wherein the drain switch valve is switched to implement one of supplying of the working fluid from a corresponding one of the at least one pilot passage to a corresponding one of the at least one drain control valve and discharging of the working fluid from the corresponding one of the at least one pilot passage.

8. The valve timing control system according to claim 6, wherein:

the follower shaft is rotatably supported by a bearing;

the phase switch valve is installed on one side of the bearing where the fluid source is located; and the at least one phase check valve and the at least one drain control valve are installed on the other side of the bearing where the retard chambers and the advance chambers of the at least three receiving chamber are located.

9. The valve timing control system according to claim 1, wherein the at least one phase check valve and the at least one drain control valve are received in the vane rotor.

10. The valve timing control system according to claim 1, wherein at least one of the at least one drain control valve respectively has:

a valve member, which is driven by the pilot pressure in a direction for blocking the corresponding fluid discharge passage; and a resilient member, which applies load to the valve member in a direction for opening the corresponding fluid discharge passage.

11. The valve timing control system according to claim 1, wherein at least one of the at least one drain control valve respectively has:

a valve member, which is driven by the pilot pressure in a direction for opening the corresponding fluid discharge passage; and a resilient member, which applies load to the valve member in a direction for blocking the corresponding fluid discharge passage.

12. A valve timing control system installed in a drive transmission system that transmits a drive force from a drive shaft of an internal combustion engine to a follower shaft, which opens and closes at least one of an intake valve and an exhaust valve of the internal combustion engine, so that the valve timing control system adjusts opening and closing timing of the at least one of the intake valve and the exhaust valve, the valve timing control system comprising:

a housing that is rotated together with one of the drive shaft and the follower shaft and has a plurality of receiving chambers, each of which is formed within a predetermined angular range in a rotational direction;

a vane rotor that is rotated together with the other one of the drive shaft and the follower shaft and has a plurality of vanes, each of which is received in a corresponding one of the plurality of receiving chambers to partition the receiving chamber into a corresponding retard chamber and a corresponding advance chamber, wherein the vane rotor is driven to rotate in a corresponding one of a retard side and an advance side relative to the housing by a pressure of working fluid in a corresponding one of each retard chamber and each advance chamber of the plurality of receiving chambers, so that a relative phase of the vane rotor relative to the housing is controlled;

a passage arrangement that includes:

a group of retard passages, each of which connects between a fluid source side and a corresponding one of the retard chambers of the plurality of receiving chambers; and a group of advance passages, each of which connects between the fluid source side and a corresponding one of the advance chambers of the plurality of receiving chambers;

at least one phase check valve that is installed in at least one predetermined passage, respectively, which is selected from the group of retard passages and the group of advance passages, wherein each phase check valve limits the working fluid to flow from a corresponding check valve connecting chamber, which is a corresponding one of the retard chambers and the advance chambers of the plurality of receiving chambers connected to the phase check valve, toward the fluid source, while the phase check valve permits the working fluid to flow from the fluid source to the corresponding check valve connecting chamber; and at least one drain control valve, each of which is driven by a pilot pressure exerted by the working fluid from the fluid source and is installed in a corresponding one of at least one fluid discharge passage, which is provided separately from the group of retard passages and the group of advance passages to discharge the working fluid from the check valve connecting chamber that is associated with a corresponding one of the at least one phase check valve, wherein:

each drain control valve blocks the corresponding fluid discharge passage when the working fluid is supplied from the fluid source to the check valve connecting chamber associated with the corresponding one of the at least one phase check valve to rotate the vane rotor in a corresponding one of the retard side and the advance side relative to the housing; and the drain control valve opens the corresponding fluid discharge passage when the working fluid is discharged from the check valve connecting chamber associated with the corresponding one of the at least one phase check valve to rotate the vane rotor in the other one of the retard side and the advance side relative to the housing; and a pressure loss of each of the at least one predetermined passage is set to be smaller than that of remaining one or more of the retard passages or the advance passages of the same group, from which the predetermined passage is selected.

13. The valve timing control system according to claim 12, wherein a passage cross sectional area of each of the at least one predetermined passage is set to be larger than that of remaining one or more of the retard passages or the advance passages of the same group, from which the predetermined passage is selected.

14. The valve timing control system according to claim 12, wherein a passage length of each of the at least one predetermined passage is set to be smaller than that of remaining one or more of the retard passages or the advance passages of the same group, from which the predetermined passage is selected.

15. The valve timing control system according to claim 12, wherein the at least one predetermined passage is a single predetermined passage, which contains the corresponding phase check valve as a single phase check valve therein, in a corresponding one of the group of retard passages and the group of advance passages.

16. The valve timing control system according to claim 12, wherein:

the at least one phase check valve includes:

at least one first-side check valve that is installed in the group of retard passages to permit the working fluid to flow from the fluid source side to the retard chamber of the corresponding one of the plurality of receiving chambers and to limit the working fluid to flow from the retard chamber of the corresponding one of the plurality of receiving chambers to the fluid source side; and at least one second-side check valve that is installed in the group of advance passages to permit the working fluid to flow from the fluid source side to the advance chamber of the corresponding one of the plurality of receiving chambers and to limit the working fluid to flow from the advance chamber of the corresponding one of the plurality of receiving chambers to the fluid source side;

the at least one fluid discharge passage includes:

at least one first-side discharge passage, each of which discharges the working fluid from the retard chamber of the corresponding one of the plurality of receiving chambers; and at least one second-side discharge passage, each of which discharges the working fluid from the advance chamber of the corresponding one of the plurality of receiving chambers; and the at least one drain control valve includes:

at least one first-side control valve, each of which is installed in a corresponding one of the at least one first-side discharge passage, wherein each first-side control valve blocks the corresponding first-side discharge passage at a time of executing a retard control operation for rotating the vane rotor in the retard side and opens the corresponding first-side discharge passage at a time of executing an advance control operation for rotating the vane rotor in the advance side; and at least one second-side control valve, each of which is installed in a corresponding one of the at least one second-side discharge passage, wherein each second-side control valve blocks the corresponding second-side discharge passage at the time of executing the advance control operation for rotating the vane rotor in the advance side and opens the corresponding second-side discharge passage at the time of executing the retard control operation for rotating the vane rotor in the retard side.

17. The valve timing control system according to claim 12, further comprising a phase switch valve that is switched to implement:

one of supplying of the working fluid from the fluid source to the retard chambers of the plurality of receiving chambers and discharging of the working fluid from the retard chambers of the plurality of receiving chambers; and one of supplying of the working fluid from the fluid source to the advance chambers of the plurality of receiving chambers and discharging of the working fluid from the advance chambers of the plurality of receiving chambers, wherein:

the group of retard passages connects between the phase switch valve and the retard chambers of the plurality of receiving chambers;

the group of advance passages connects between the phase switch valve and the advance chambers of the plurality of receiving chambers; and each fluid discharge passage, in which the corresponding drain control valve is installed, bypasses a corresponding one of the at least one phase check valve and connects the corresponding check valve connecting chamber, which is associated with the corresponding one of the at least one phase check valve, to the phase switch valve.

18. The valve timing control system according to claim 17, further comprising a drain switch valve that is installed in at least one pilot passage, which is branched from a supply passage that supplies the working fluid from the fluid source to the phase switch valve, and which is connected to the at least one drain control valve to apply the pilot pressure to the at least one drain control valve by the working fluid supplied from the fluid source, wherein the drain switch valve is switched to implement one of supplying of the working fluid from a corresponding one of the at least one pilot passage to a corresponding one of the at least one drain control valve and discharging of the working fluid from the corresponding one of the at least one pilot passage.

19. The valve timing control system according to claim 17, wherein:

the follower shaft is rotatably supported by a bearing;

the phase switch valve is installed on one side of the bearing where the fluid source is located; and the at least one phase check valve and the at least one drain control valve are installed on the other side of the bearing where the retard chambers and the advance chambers of the plurality of receiving chamber are located.

20. The valve timing control system according to claim 12, wherein the at least one phase check valve and the at least one drain control valve are received in the vane rotor.

21. The valve timing control system according to claim 12, wherein at least one of the at least one drain control valve respectively has:

a valve member, which is driven by the pilot pressure in a direction for blocking the corresponding fluid discharge passage; and a resilient member, which applies load to the valve member in a direction for opening the corresponding fluid discharge passage.

22. The valve timing control system according to claim 12, wherein at least one of the at least one drain control valve respectively has:

a valve member, which is driven by the pilot pressure in a direction for opening the corresponding fluid discharge passage; and a resilient member, which applies load to the valve member in a direction for blocking the corresponding fluid discharge passage.

* * * * *